US011198553B2

(12) United States Patent
Poirier et al.

(10) Patent No.: US 11,198,553 B2
(45) Date of Patent: Dec. 14, 2021

(54) PILL DISPENSER

(71) Applicant: 9769633 CANADA INC., Quebec (CA)

(72) Inventors: Michel Poirier, Lac-Beauport (CA); Paul-André Bouchard, Outremont (CA)

( * ) Notice: Subject to any disclaimer, the term of this patent is extended or adjusted under 35 U.S.C. 154(b) by 0 days.

(21) Appl. No.: 16/329,982

(22) PCT Filed: Sep. 1, 2017

(86) PCT No.: PCT/IB2017/055284

§ 371 (c)(1),
(2) Date: Mar. 1, 2019

(87) PCT Pub. No.: WO2018/042387

PCT Pub. Date: Mar. 8, 2018

(65) Prior Publication Data

US 2019/0193922 A1 Jun. 27, 2019

Related U.S. Application Data

(60) Provisional application No. 62/383,450, filed on Sep. 4, 2016.

(51) Int. Cl.

| | |
|---|---|
| ***B65D 83/04*** | (2006.01) |
| ***A61J 7/00*** | (2006.01) |
| ***A61J 1/14*** | (2006.01) |

(52) U.S. Cl.

CPC ..... *B65D 83/049* (2013.01); *A61J 1/1418* (2015.05); *A61J 7/0076* (2013.01)

(58) Field of Classification Search

CPC ..... A61J 7/0076; A61J 7/1418; B65D 83/049; B65D 83/0409; B65D 2215/02; B65D 2583/0481

See application file for complete search history.

(56) References Cited

U.S. PATENT DOCUMENTS

| | | | | |
|---|---|---|---|---|
| 3,527,383 A * | 9/1970 | Borsum | B65D 83/0409 221/112 |
| 4,024,984 A * | 5/1977 | Gyimothy | B65D 83/0409 221/203 |
| 4,489,853 A * | 12/1984 | Korte | A61J 7/0076 221/187 |
| 6,651,840 B1 * | 11/2003 | Van Dullemen | B65B 69/0058 221/88 |

(Continued)

OTHER PUBLICATIONS

International Search Report and Written Opinion issued in corresponding International Application No. PCT/IB2017/055284, dated Dec. 21, 2017, 10 pages.

*Primary Examiner* — Gene O Crawford
*Assistant Examiner* — Kelvin L Randall, Jr.
(74) *Attorney, Agent, or Firm* — Benoit & Cote, Inc.; C. Marc Benoit

(57) ABSTRACT

The present invention relates to a dispenser for use with a pill container. The dispenser comprises a base, a reciprocating element, a revolving distributor and a cam assembly, whereby the cam assembly translates a reciprocation of the reciprocating element into a rotation of the revolving distributor and allow dispensing a single pill at each reciprocation cycle. The dispenser of the present invention allows patients to be provided with medications by an easy-to-use means for dispensing of a single dosage by a simple press of a hand.

22 Claims, 30 Drawing Sheets

(56) References Cited

U.S. PATENT DOCUMENTS

| | | | | |
|---|---|---|---|---|
| 7,810,673 | B2 * | 10/2010 | Lancesseur | B65D 83/0409 221/151 |
| 8,033,422 | B2 | 10/2011 | Estrada | |
| 8,727,180 | B2 | 5/2014 | Zonana et al. | |
| 2011/0060457 | A1 * | 3/2011 | De Vrught | A61J 1/03 700/241 |
| 2017/0057730 | A1 * | 3/2017 | Wang | G01F 13/001 |
| 2018/0229918 | A1 * | 8/2018 | Petit | A61J 7/0053 |
| 2019/0307228 | A1 * | 10/2019 | Baumann | A45D 34/041 |

* cited by examiner

PILL DISPENSER

TECHNICAL FIELD

The present invention relates to a pill dispenser, and more particularly to a pill dispenser adapted to be secured onto a container for dispensing a single pill at a time.

BACKGROUND OF THE ART

Pill dispensers have been intensively developed over the past decades to provide people with adapted solutions to dispense pills, tablets, and other forms of solid medications. Pill dispensers tend to generally comprise a bottle, a cap and a dispensing mechanism for dispensing pills. Some pill dispensers may further enable the user to dispense only a single pill at a time, as some prescriptions require only a single pill to be taken by a user.

In some cases, to operate these pill dispensers, a user must simultaneously exert pressure and rotate the cap to dispense pills. In other cases, a user can dispense pills by only rotating the cap. While these pill dispensers may be useful with some type of patients, they tend to be of limited use with patients suffering from Parkinson's disease, for example. Indeed, parkinsonians are subject to fine motor skills limitations such as slowness of movement, rigidity and stiffness of members, continuous contraction of muscles and constant shakiness. Likewise, these pill dispensers tend to be of limited use with patients suffering from arthritis, which affect an estimated 30.8 million adults worldwide in the case of osteoarthritis only. Arthritis is mostly characterized by joint pain and stiffness and affect more particularly the hips, knees and fingers. In the latter case, arthritis usually result in a progressive inability to use one or both hands. For both parkinsonians and arthritic patients, it therefore tends to be very difficult for them to grab a pill dispenser, exert a pressure on it and rotate the cap for dispensing a single pill. In many cases, people suffering from Parkinson's disease, arthritis or other diseases thus have to rely on relatives, nurses or specialized care to get access to their medication and/or to comply with the prescribed posology.

There is therefore a need for an improved single pill dispenser adapted to overcome at least one of the above identified drawbacks.

SUMMARY

According to a broad aspect of an embodiment of the present invention, there is provided a dispenser for use with a container having a body and an orifice. In this aspect, the dispenser comprises:

a. a base including a base recess and a dispensing opening;

b. a reciprocating element mounted in the base recess for reciprocation between an uncompressed position and a compressed position, the reciprocating element including an annular recess and a dispensing channel configured to engage the dispensing opening of the base and to allow the passage of a pill from the annular recess, the reciprocating element further including a means for securing the dispenser to the container;

c. a first biasing assembly operatively coupled to the reciprocating element and configured to bias the same toward the uncompressed position;

d. a revolving distributor rotatably mounted in the annular recess of the reciprocating element, the revolving distributor including at least one dispensing space, the revolving distributor being rotatable about a rotation axis for allowing the dispensing space to move between a filling position for allowing a pill to be dispensed to be received in the at least one dispensing space and a dispensing position in which the at least one dispensing space is in alignment with the dispensing channel of the reciprocating element;

e. a means for preventing rotation of the reciprocating element relative about the rotation axis;

f. a blocker for blocking access to the at least one dispensing space in the dispensing position;

g. a cam assembly operatively coupled to the reciprocating element and to the revolving distributor, wherein when the reciprocating element is moved between the compressed and the uncompressed positions, the cam forces the revolving distributor to rotates such that the at least one dispensing space moves from the filling position to the dispensing position.

In one feature, the base of the dispenser comprises a circular bottom wall, a cylindrical side wall extending upwardly from the bottom wall and a base projection extending upwardly from the center of the bottom wall to define the rotation axis. In this feature, the bottom wall, the side wall, and the base projection together define the base recess, and the dispensing opening is defined in the bottom wall, eccentric to the rotation axis.

In another feature, the base projection comprises a lower portion, a middle portion and an upper portion. In this feature, the lower portion has a lower end adjacent to the bottom wall of the base and an upper end defining a priming portion of the cam assembly. The lower portion also has a cylindrical wall extending therebetween, the cylindrical wall of the lower portion defining a first diameter $D_1$.

Preferably, the middle portion of the base projection has a first end adjacent to the lower portion, a second end adjacent to the upper portion and a cylindrical wall extending therebetween, the cylindrical wall of the middle portion defining a second diameter $D_2$. More preferably, the upper portion of the base projection comprises a first end adjacent to the second end of the middle portion, a second end and a peripheral wall configured to engage the blocker.

In an additional feature, the reciprocating element comprises an annular bottom wall, an inner cylindrical wall and an outer cylindrical wall. In this feature, the inner and outer cylindrical walls are spaced-apart from one another and extend upwardly from the annular bottom wall, to define the annular recess of the reciprocating element. The reciprocating element further comprises a bore defined by the inner cylindrical wall, the bore having a third diameter $D_3$ adapted to receive therein the lower portion of the base projection. Preferably, the inner cylindrical wall comprises a lower end adjacent to the annular bottom wall of the reciprocating element and an upper end, the upper end of the inner cylindrical wall defining a dispensing portion of the cam assembly.

In yet another feature, the means for securing the dispenser to the container comprises a first thread portion defined on the reciprocating element. In this feature, the first thread portion is configured to threadably engage a second thread portion defined on the body of the container.

In an additional feature, the means for preventing rotation of the reciprocating element comprises at least one groove defined in one of the base and the reciprocating element and at least one corresponding tongue defined in the other of the base and the reciprocating element.

In still another feature, the revolving distributor comprises a lower dispensing portion and an upper cam portion.

Preferably, the lower dispensing portion of the revolving distributor comprises a cylindrical wall and at least one dispensing projection extending radially therefrom, the at least one dispensing projection defining the at least one dispensing space. More preferably, the cylindrical wall of the lower dispensing portion defines a bore adapted to receive therein the inner cylindrical wall of the reciprocating element and the base projection for allowing rotation of the revolving distributor about the rotation axis.

In yet another feature, the at least one dispensing projection comprises a pushing portion and an arm portion for attaching the pushing portion to the cylindrical wall of the lower dispensing portion of the revolving distributor. Preferably, the pushing portion of the dispensing projection is generally U-shaped.

In a further feature the revolving distributor comprises six projections, the projections defining together six dispensing spaces.

In another feature, the at least one dispensing space has size and shape corresponding to size and shape of the dispensing channel.

In still another feature, the upper cam portion of the revolving distributor comprises a cylindrical wall having an upper end and a lower end. In this feature, the lower end of the cylindrical wall of the upper cam portion is configured to collaborate with the priming portion of the base and the dispensing portion of the reciprocating element to define the cam assembly. Preferably, the cam assembly comprises:

a. a plurality of slanted teeth extending from the priming portion of the base projection;
b. a corresponding plurality of slanted teeth extending from the dispensing portion of the inner cylindrical wall of the reciprocating element comprises;
c. a corresponding plurality of complementary teeth extending from the cam portion of the revolving distributor, the plurality of complementary teeth of the cam portion being configured to engage the teeth of the priming and dispensing portions of the base projection and reciprocating element when the reciprocating member is moved between the uncompressed position and the compressed position.

In an additional feature, the first biasing assembly comprises a spring. Preferably, the spring is a coil spring. More preferably, the coil spring has a first end in contact with the circular bottom wall of the base, a second end in contact with the bottom wall of the reciprocating element and a coil extending therebetween.

In a further feature, the blocker is mounted to the base projection. Preferably, the blocker comprises a cylindrical body including a circular top wall and a cylindrical wall extending downwardly from the top wall. The blocker further comprises a blocking projection extending radially from the cylindrical wall of the cylindrical body atop of the dispensing channel of the reciprocating element, and a mounting member extending downwardly from the circular top wall of the cylindrical body, the mounting member of the blocker being configured to engage the upper portion of the base projection and to prevent rotation of the blocker about the rotation axis.

In another feature, the dispenser further comprises a conical cover mounted on the blocker. In this feature, the conical cover is configured to direct pills to be dispensed toward the at least one dispensing space when the at least one dispensing space is in filling position.

In still another feature, the dispenser further comprises a second biasing assembly operatively coupled to the revolving distributor and configured to bias the same toward the base. Preferably, the second biasing assembly comprises a coil spring.

In yet another feature, the dispenser further comprises a support for placing the dispenser on a horizontal surface or in a recipient. Preferably, the support comprises a cylindrical wall having a diameter substantially corresponding to the diameter of the base, and means for securing the support to the base. The recipient can be a glass, a can or a cup and is preferably adapted to be grasped by a user with reduced mobility and to be brought to the mouth for consumption of the pill dispensed therein without the need for the user to contact the pill.

According to another broad aspect of an embodiment of the invention, there is provided a dispenser comprising:

a. a container having a body and an orifice;
b. a base including a base recess and a dispensing opening;
c. a reciprocating element mounted in the base recess for reciprocation between an uncompressed position and a compressed position, the reciprocating element including an annular recess and a dispensing channel configured to engage the dispensing opening of the base and to allow the passage of a pill from the annular recess, the reciprocating element further including a means for securing the reciprocating element to the container;
d. a first biasing assembly operatively coupled to the reciprocating element and configured to bias the same toward the uncompressed position;
e. a revolving distributor rotatably mounted in the annular recess of the reciprocating element, the revolving distributor including at least one dispensing space, the revolving distributor being rotatable about a rotation axis for allowing the dispensing space to move between a filling position for allowing a pill to be dispensed to be received in the at least one dispensing space and a dispensing position in which the at least one dispensing space is in alignment with the dispensing channel of the reciprocating element;
f. a means for preventing rotation of the reciprocating element relative about the rotation axis;
g. a blocker for blocking access to the at least one dispensing space in the dispensing position;
h. a cam assembly operatively coupled to the reciprocating element and to the revolving distributor, wherein when the reciprocating element is moved between the compressed and the uncompressed positions, the cam forces the revolving distributor to rotates such that the at least one dispensing space moves from the filling position to the dispensing position.

BRIEF DESCRIPTION OF THE DRAWINGS

Having thus generally described the nature of the invention, reference will now be made to the accompanying drawings, showing by way of illustration a preferred embodiment thereof and in which.

DETAILED DESCRIPTION

Figure 1:
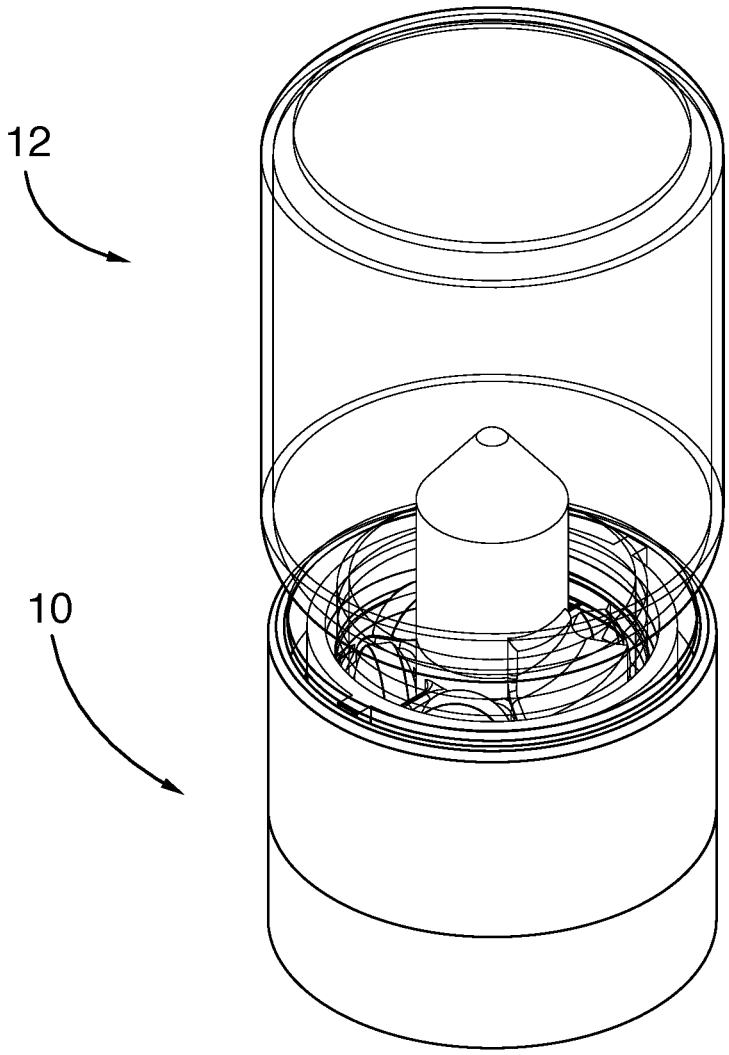
FIG. 1 is a side perspective view of a dispenser according to one embodiment of the present invention, with a pill container secured thereto.

The description which follows, and the embodiments described therein are provided by way of illustration of an example, or examples of particular embodiments of principles and aspects of the present invention. These examples are provided for the purpose of explanation and not of limitation, of those principles of the invention. In the description that follows, like parts are marked throughout the specification and the drawings with the same respective reference numerals.

Figure 2:
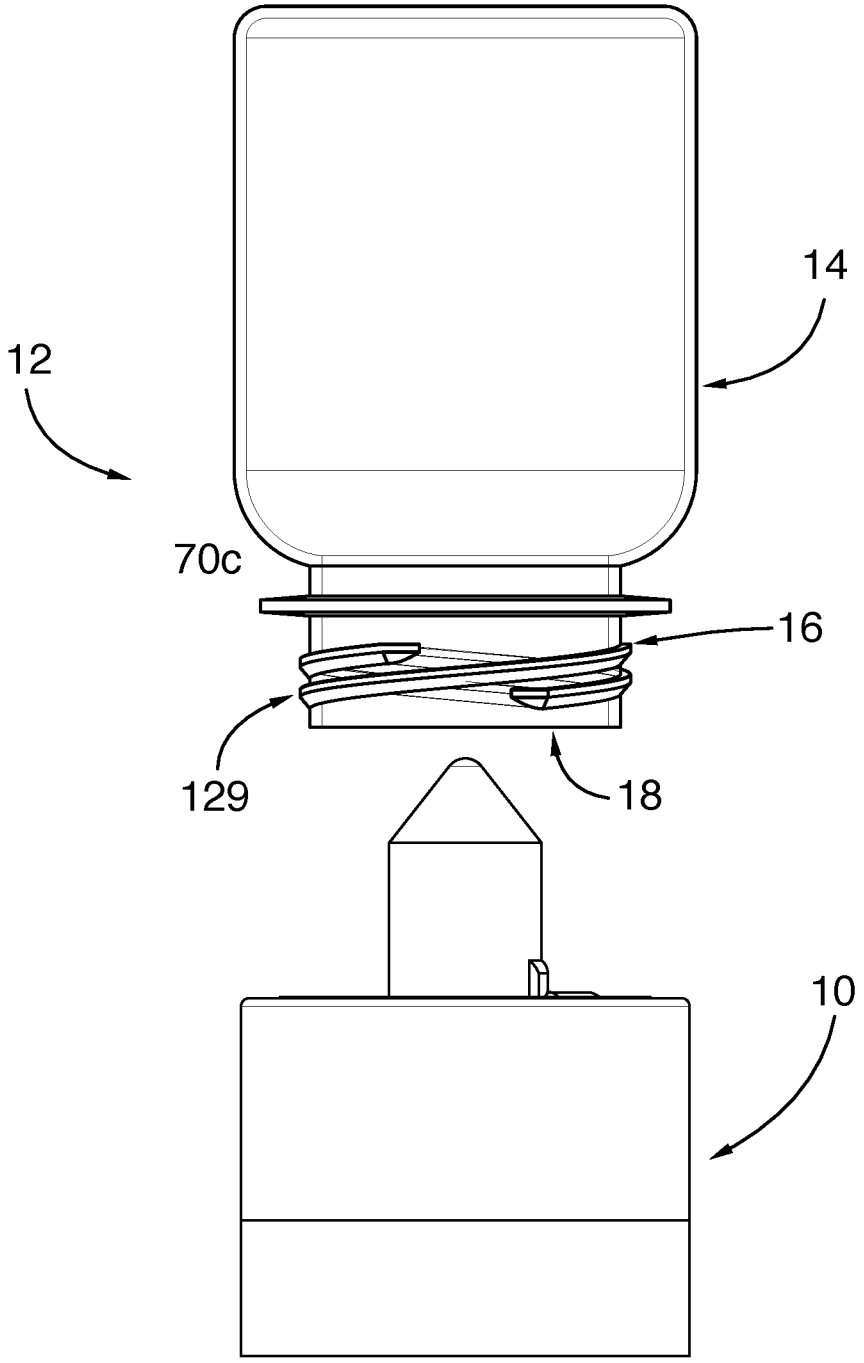
FIG. 2 is a side elevation view of the dispenser shown in FIG. 1, with the container detached from the dispenser.
Figure 3:
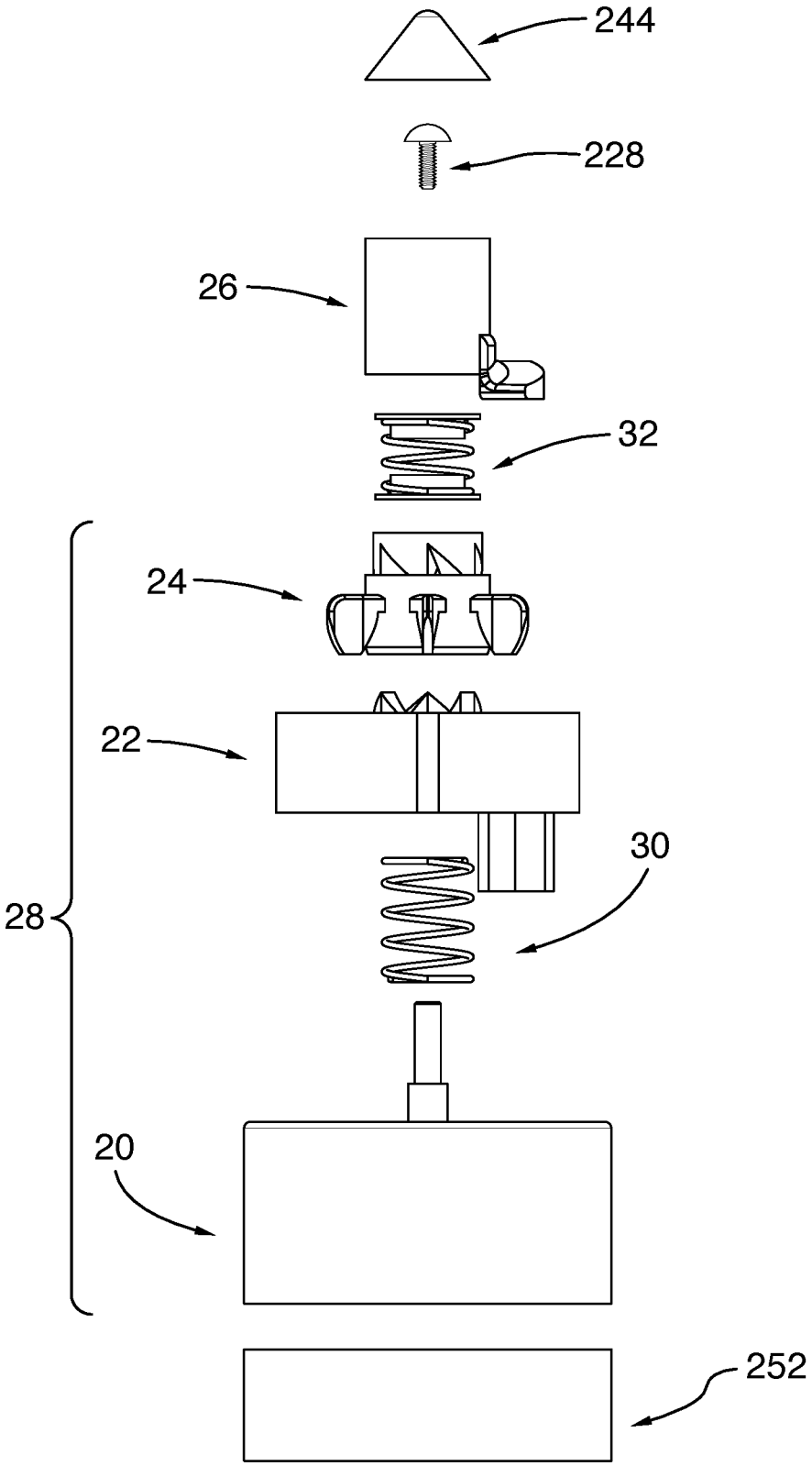
FIG. 3 is a side exploded view of the dispenser shown in FIG. 1.
Figure 4:
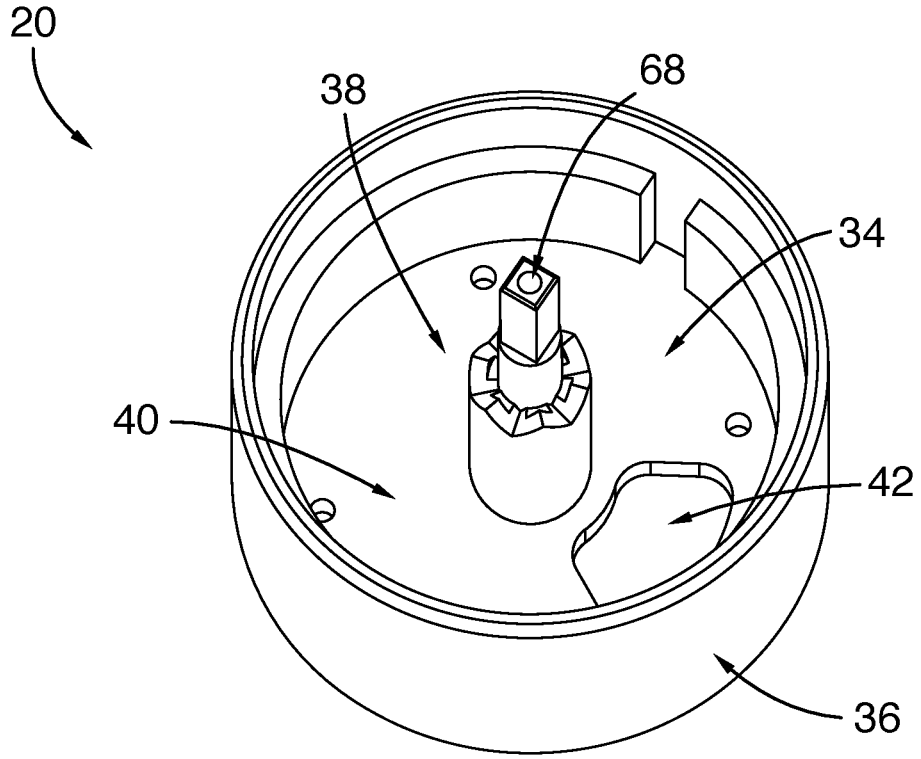
FIG. 4 is a top perspective view of the base of the dispenser shown in FIG. 1.
Figure 5:
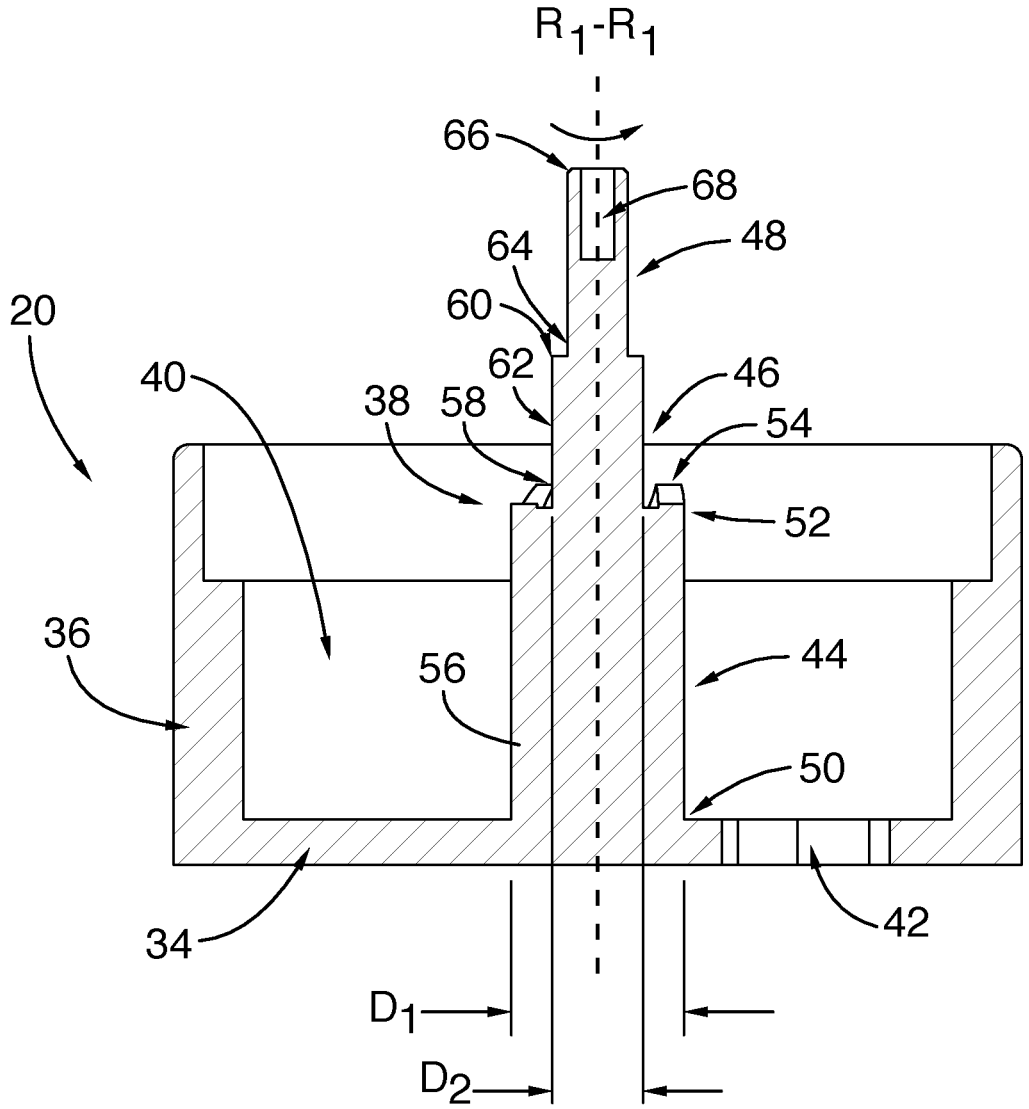
FIG. 5 is a cross-section view of the base shown in FIG. 4, taken along line V-V.
Figure 6:
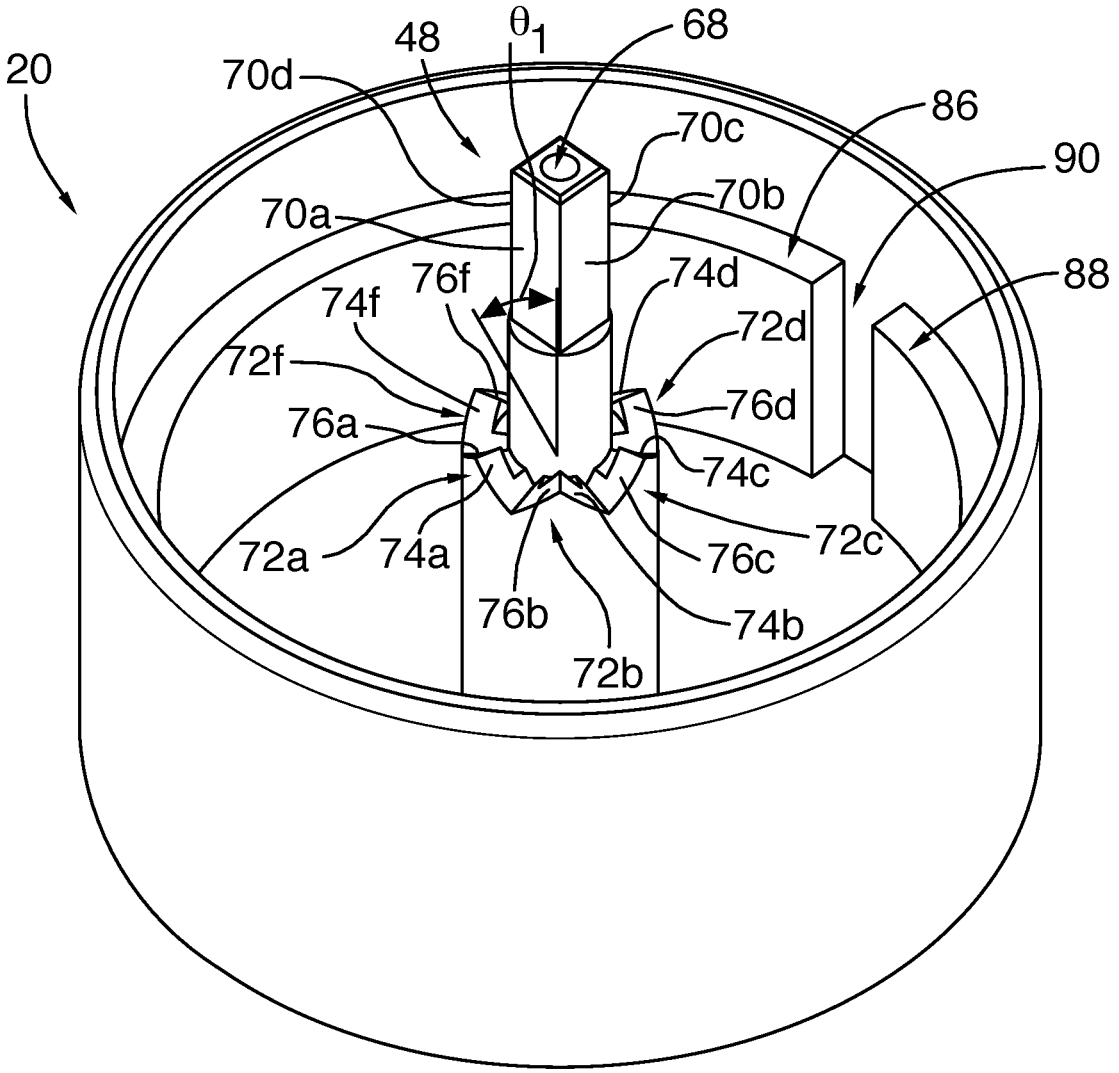
FIG. 6 is an enlarged to perspective view of the base shown in FIG. 4.
Figure 7:
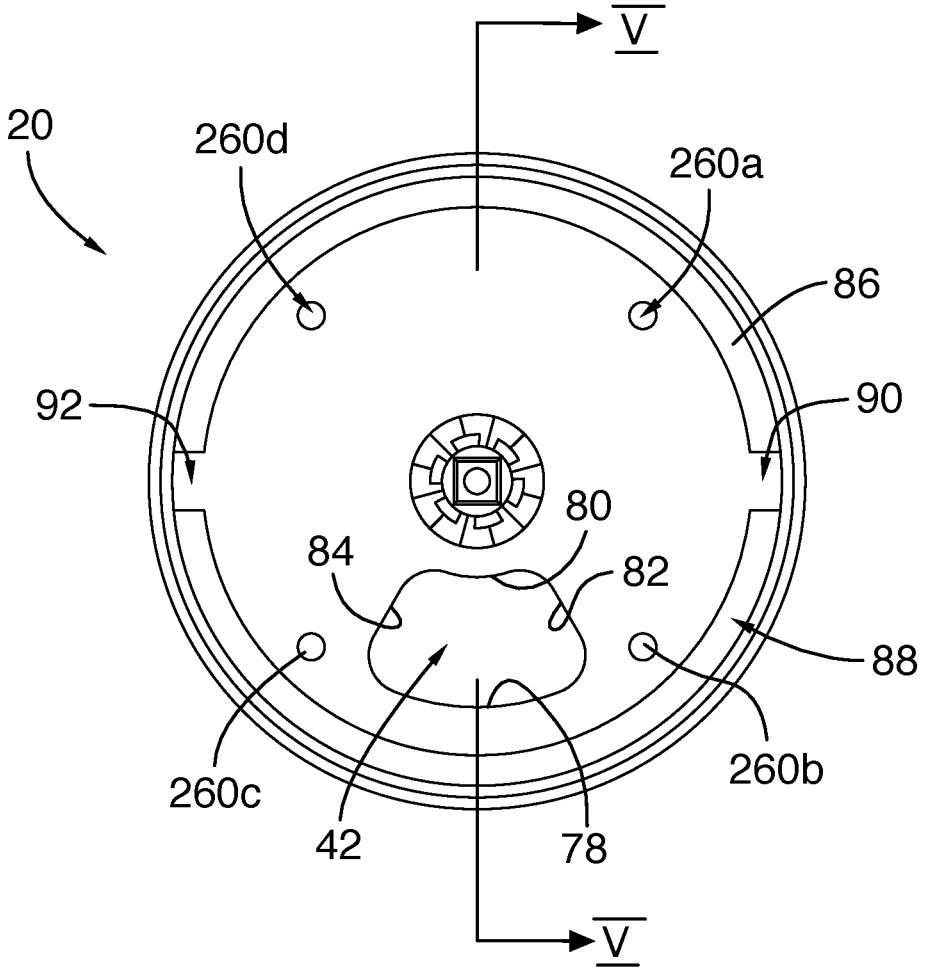
FIG. 7 is a top plan view of the base shown in FIG. 4.
Figure 8:
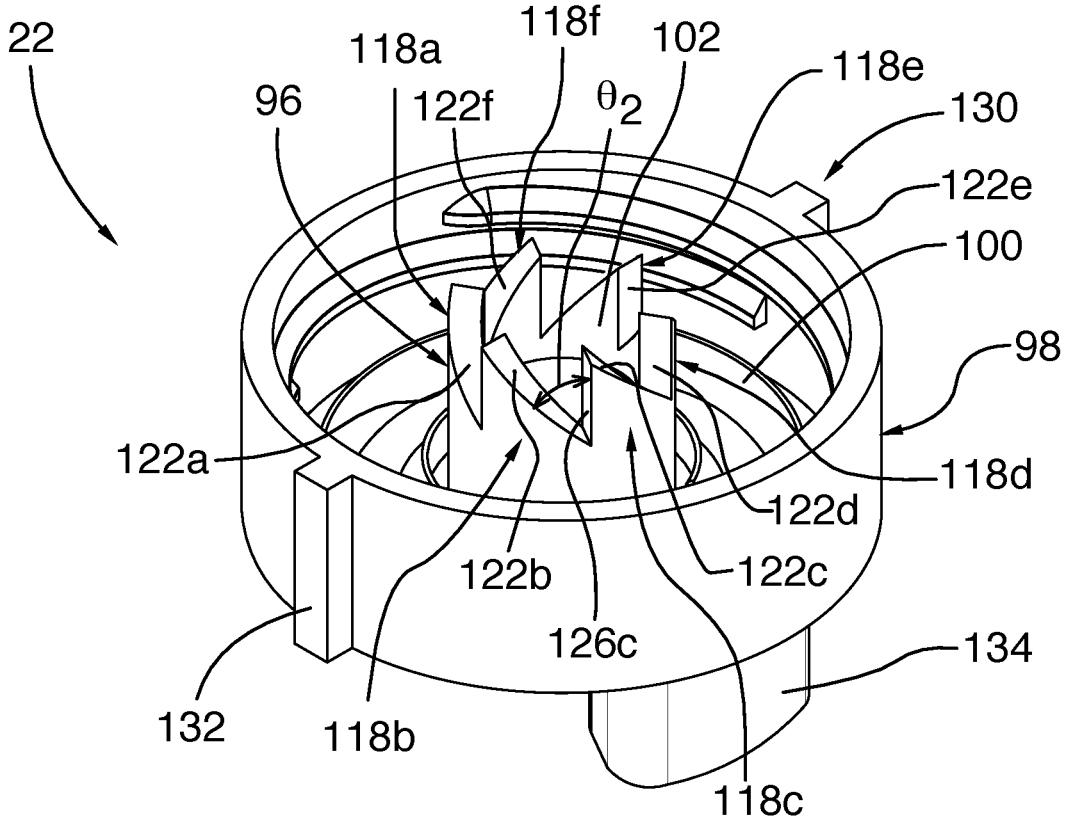
FIG. 8 is a side perspective view of the reciprocating element of the dispenser shown in FIG. 1.
Figure 9:
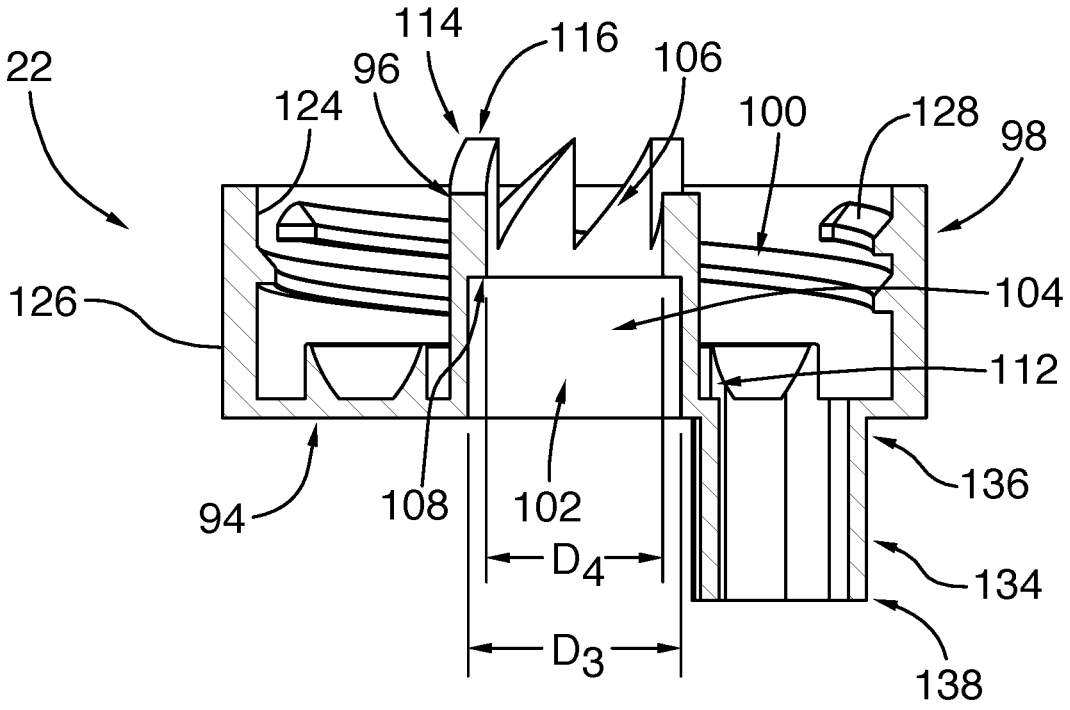
FIG. 9 is a cross-section view of the reciprocating element shown in FIG. 8, taken along line IX-IX.

With reference to FIGS. 1 to 3, there is shown a dispenser 10 for use with a pill container 12. In this embodiment, the pill container 12 is a pill bottle such as those known in the art and includes a generally cylindrical body 14, a neck 16 and an orifice 18, but the dispenser 10 could be used with containers having different shapes. For instance, dispenser 10 could be used with a container comprising a cylindrical body with no neck such as a pharmacy jar. As such, the term "container" as intended herein should be understood broadly as including any type of container, including bottles, pharmacy bottles, medicine bottles, jars and the like. Furthermore, while containers generally have rounded or cylindrical shapes, the dispenser 10 can be used with containers of various shapes, including containers having rectangular or square bodies.

As intended herein, the term "pill" should be understood broadly as including any solid dosage form, such as tablets, capsules, caplets, caps, gel caps, capsules, pellets, lozenges, pastilles and the like. While the dispenser of the present invention may be particularly useful in connection with medication dosages, it could find use in other applications where any other forms of solid dosage is susceptible to be dispensed. For instance, it could be used to dispense vitamins, foods (e.g. for human or animal), candies and the like. While the present dispenser is suitable for use with different shapes and sizes of pills, it is particularly suitable for use with round pills having curved top and bottom faces and a cylindrical side face such as Tylenol™ pills or round pills having an ellipsoidal cross-section such as Advil™ pills.

Figure 25:
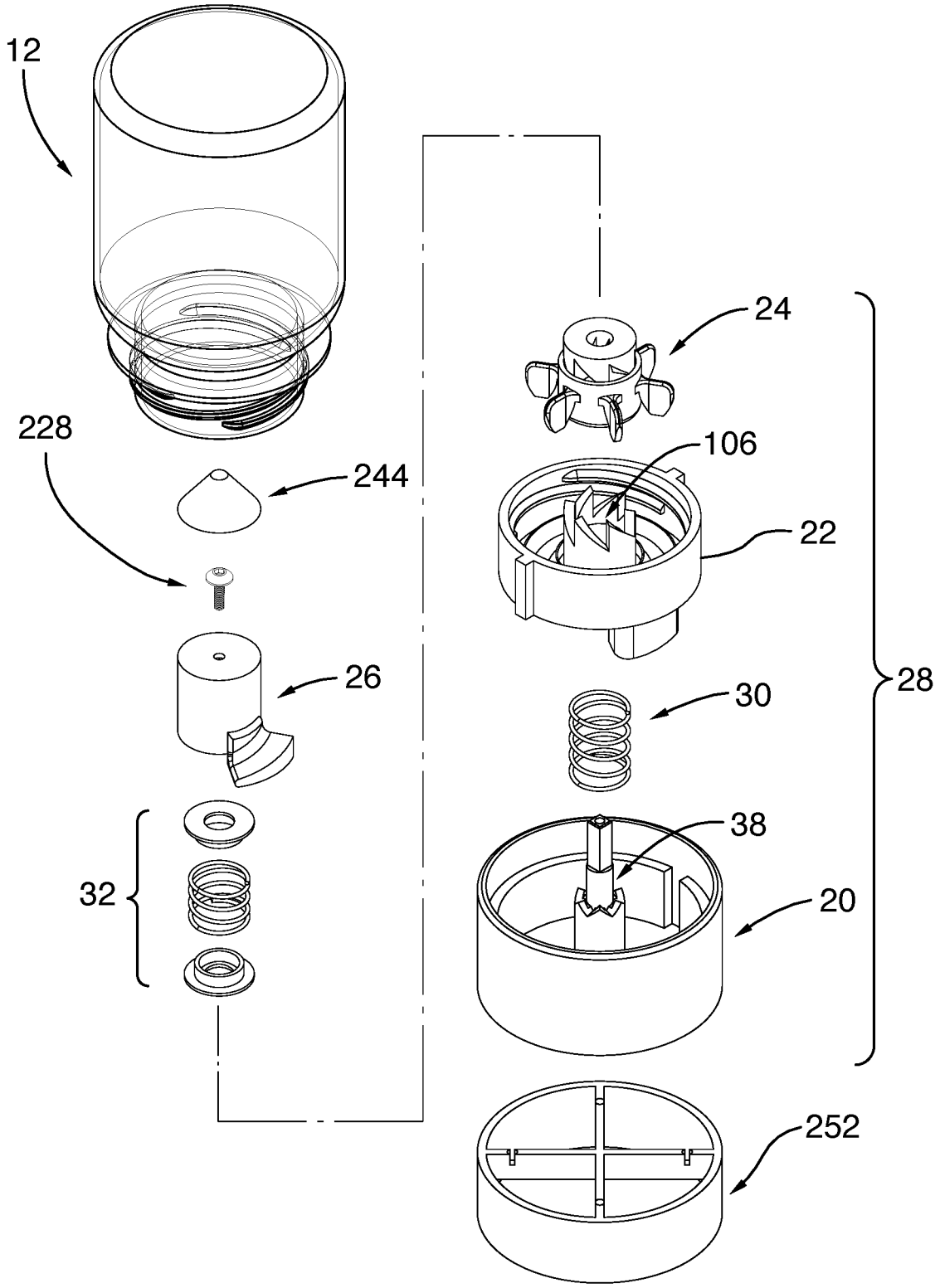
FIG. 25 is an perspective exploded view of the dispenser and container shown in FIG. 1.
Figure 26A:
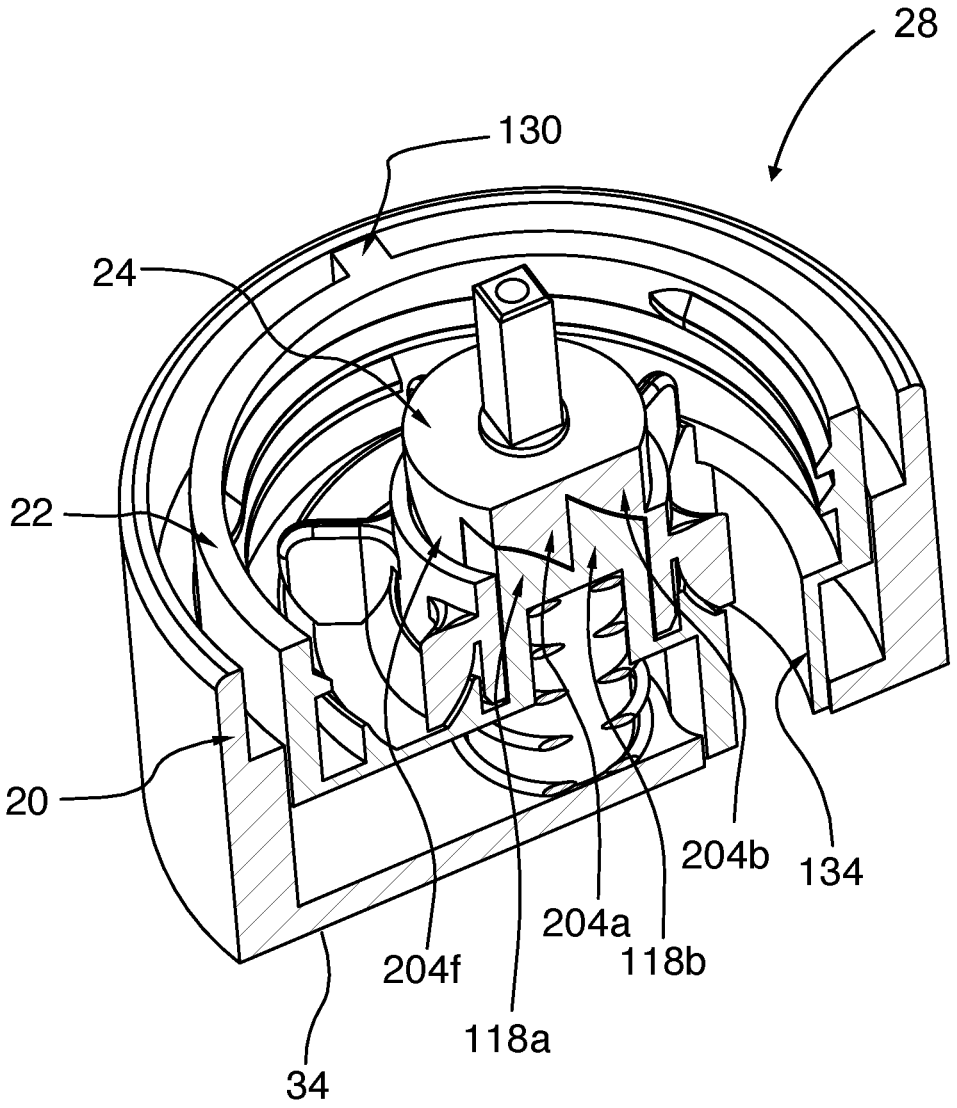
FIGS. 26A-26C are perspective, cross-section views of the base, first biasing assembly, reciprocating element and revolving distributor, with the reciprocating element and the first biasing assembly moved from the uncompressed position (FIG. 26A) to the compressed position (FIG. 26B) and back to the uncompressed position (FIG. 26C)
Figure 26B:
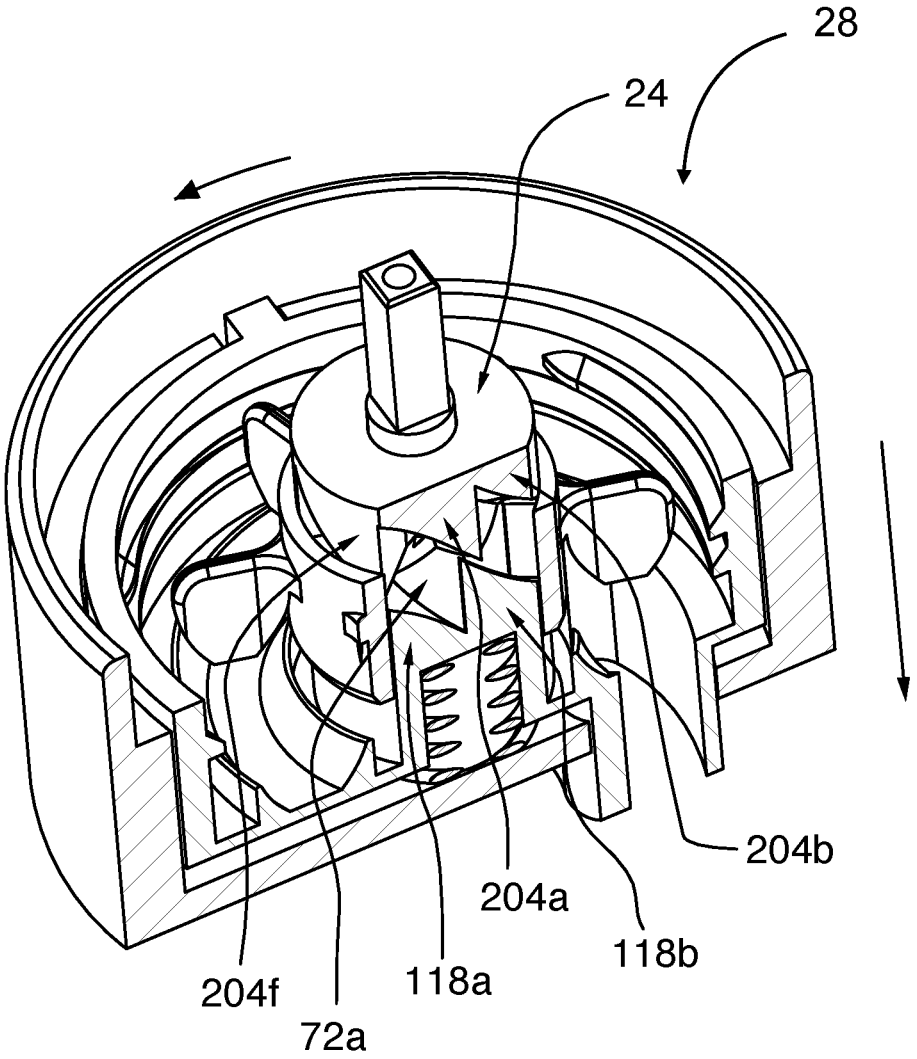
Figure 26C:
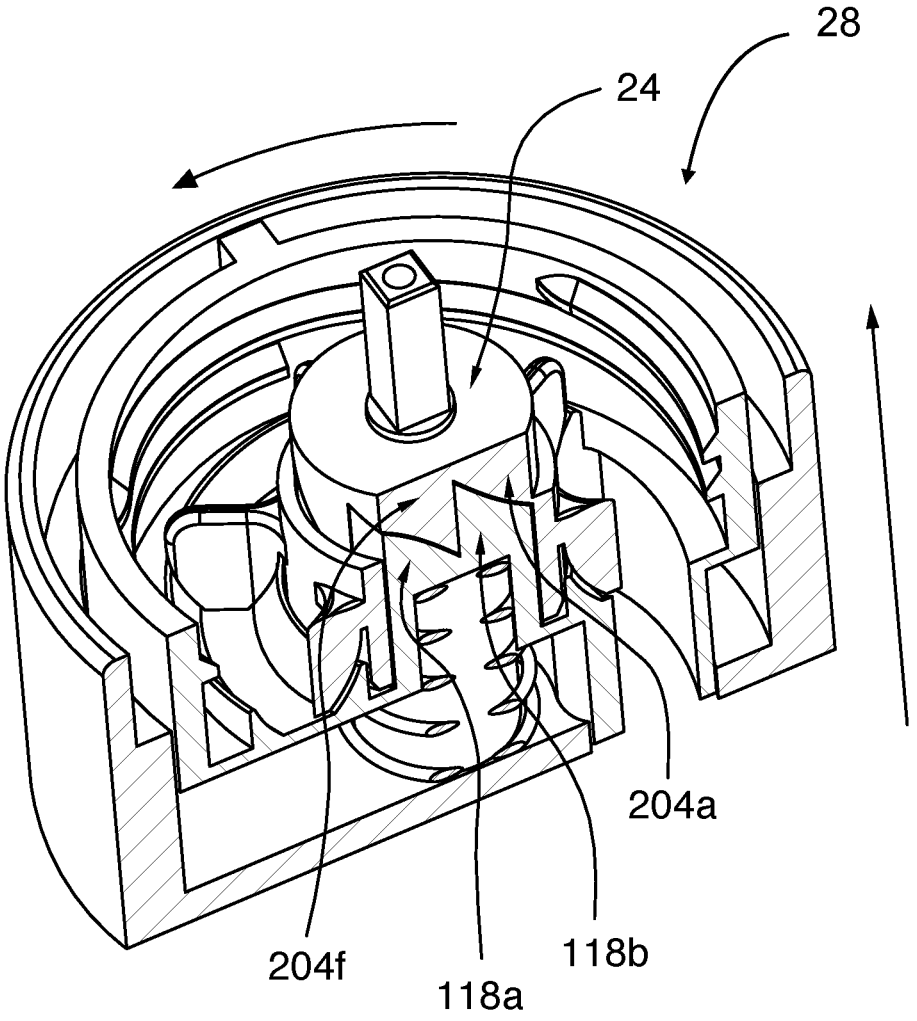
Figure 27A:
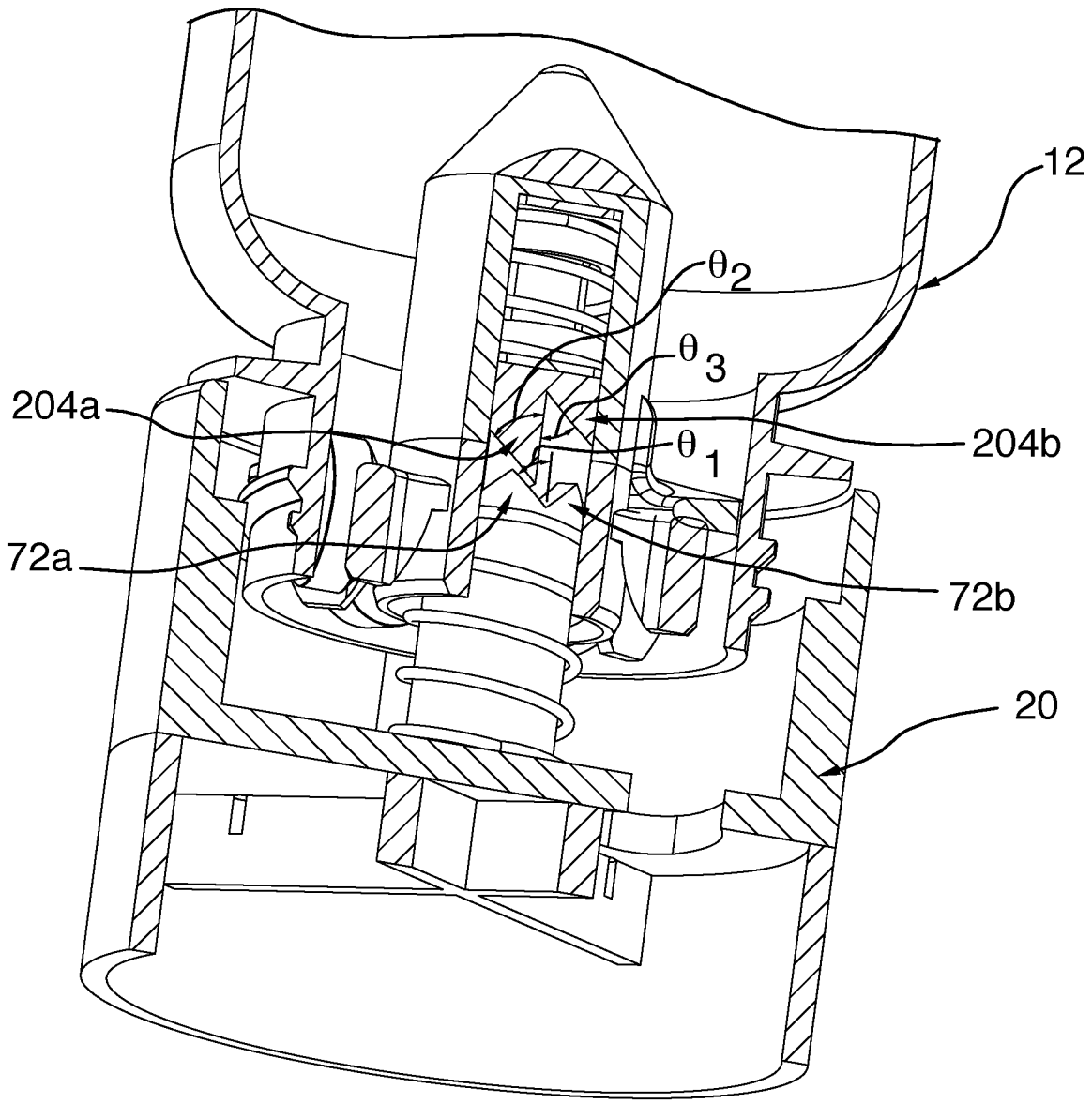
FIGS. 27A-27B are bottom perspective, cross-section views of the dispenser and the container shown in FIG. 1, with the reciprocating element removed for better showing the engagement between the teeth of the revolving distributor and the teeth of the base, where the reciprocating element would be in the uncompressed position (FIG. 27A) and in the compressed position (FIG. 27B)
Figure 27B:
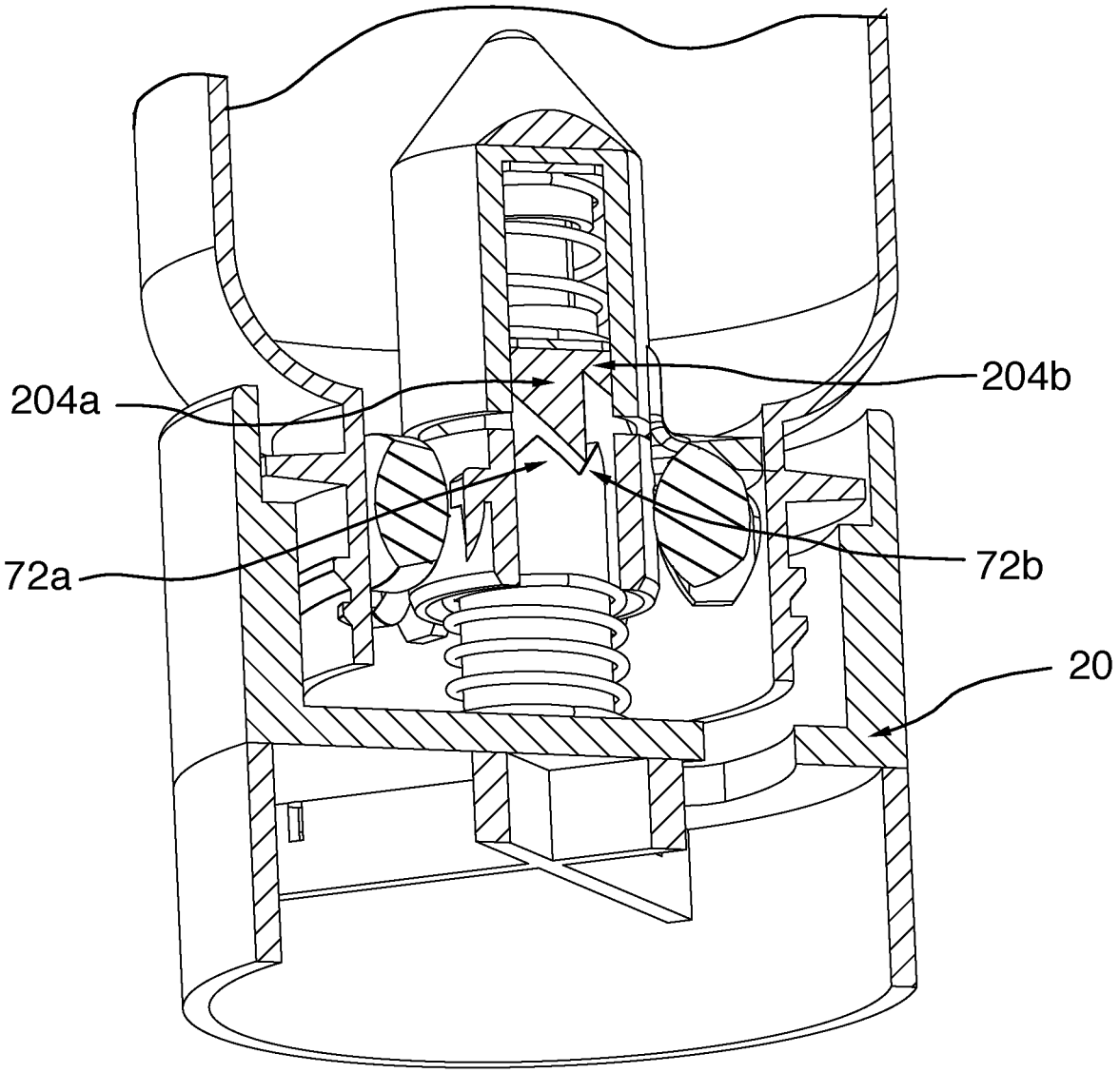

According to the illustrated embodiment, the dispenser 10 comprises a base 20, a reciprocating element 22 concentrically mounted for reciprocation in the base 20 and configured to secure the dispenser 10 to the container 12, a revolving distributor 24 and a blocker 26. As it will become apparent below, the base 20, the reciprocating element 22 and the revolving distributor 24 are configured to define together a cam assembly 28 (shown in FIGS. 3, 21, 22, 25, and 26A-26C) that will translate the reciprocation movement of the reciprocating element 22 in the base 20 into a rotation movement of the revolving distributor 24 to dispense a single pill each time the dispenser 10 is actuated (as shown in FIG. 26A-26C). The dispenser 10 further comprises a first biasing assembly 30 operatively coupled to the base 20 and the reciprocating element 22, and a second biasing assembly 32 operatively coupled to the revolving distributor 24 and the blocker 26. The two biasing assemblies 30 and 32 collaborate to bias the cam assembly 28 for facilitating a proper translation of the reciprocation movement of the reciprocating element 22 into the rotation of the revolving distributor 24, as it will become apparent below.

With reference to FIGS. 4 to 7, the base 20 of the dispenser 10 comprises a circular bottom wall 34, a cylindrical side wall 36 extending upwardly from the bottom wall 34 and a base projection 38 extending upwardly from the center of the bottom wall 34 to define a rotation axis $R_1$-$R_1$. Together, the bottom wall 34, the side wall 36 and the base projection 38 define an annular base recess 40 for receiving the reciprocating element 22, as it will be described in greater details below. The base 20 also comprises a dispensing opening 42, defined in the bottom wall 34 of the base 20, eccentric to the rotation axis $R_1$-$R_1$. While in the illustrated embodiment the cylindrical side wall 36 defines a generally circular base when seen from the top (see FIG. 7 for instance), it will be apparent to the person skilled in the art that the base 20 could be of any other shape, provided that the shape of base recess 40 is adapted to receive reciprocating element 22, as it will become apparent below.

Base projection 38 extends upwardly from the circular bottom wall 34 of base 20 and includes a lower portion 44, a middle portion 46 and an upper portion 48. The lower portion 44 of projection 38 includes a lower end 50 adjacent to the bottom wall 34 of the base 20 and an upper end 52 defining a priming portion 54 of the cam assembly or mechanism 28. The lower portion 44 of projection 38 further includes a cylindrical wall 56 extending between lower end 50 and upper end 52, the cylindrical wall 56 of the lower portion 44 defining a first diameter $D_1$, perpendicular to the rotation axis $R_1$-$R_1$.

The priming portion 54 of the cam assembly 28 comprises six teeth 72*a*-72*f*, each tooth 72*a*-72*f* including a pair of slanted faces 74*a*-74*f* and 76*a*-76*f*. Slanted faces 74*a*-74*f* and 76*a*-76*f*, where each of the slanted faces 76*a*-76*f* defines an angle $\theta_1$ relative to the rotation axis $R_1$-$R_1$. The middle portion 46 of the projection 38 has a first end 58 adjacent to the lower portion 44, a second end 60 adjacent to the upper portion 48 and a cylindrical wall 62 extending therebetween, the cylindrical wall 62 of the middle portion 46 defining a second diameter $D_2$ perpendicular to the rotation axis $R_1$-$R_1$.

The upper portion 48 of the projection 38 comprises a first end 64 adjacent to the second end 60 of the middle portion 46, a second, upper end 66 provided with a threaded bore 68 for securing the blocker 26, as it will become apparent below. The upper portion 48 also comprises four walls 70*a*-70*d* defining a generally square cross-section. While in the illustrated embodiment the upper portion 48 has a generally square cross-section, it will be understood that the upper portion 48 could have a different cross-section. For instance, it could be a triangular cross-section or any other cross-section or configuration adapted to prevent rotation of blocker 26 about rotation axis $R_1$-$R_1$. In the illustrated embodiment, the lower, middle and upper portions 44, 46 and 48 of the projection 38 form an integral structure with the other elements of the base 20 and are manufactured from a plastic material by plastic molding or 3D printing. In an alternate embodiment, the projection 38 could be manufactured separately and assembled to the other components of the base 20 using glue, rivet, threaded fastener or any other type of suitable fasteners, provided that rotation of the upper portion 48 of projection 38 is prevented from rotating about rotation axis $R_1$-$R_1$. The person skilled in the art will appreciate that the base 20 could be manufactured from any other suitable type of material such as, for instance, aluminum or another metal material.

The opening 42 of the base 20 has a generally curved trapezoidal shape and include a curved outer edge 78, a curved inner edge 80, and a pair of side edges 82, 84 extending between the curved outer and inner edges 78, 80.

The base 20 further comprises a pair of generally semi annular abutments 86, 88 extending upwardly from the bottom wall 34 of the base 20, adjacent to cylindrical wall 36. Defined between abutments 86, 88 is a pair of grooves 90, 92 extending upwardly from the bottom wall 34.

Figure 10:
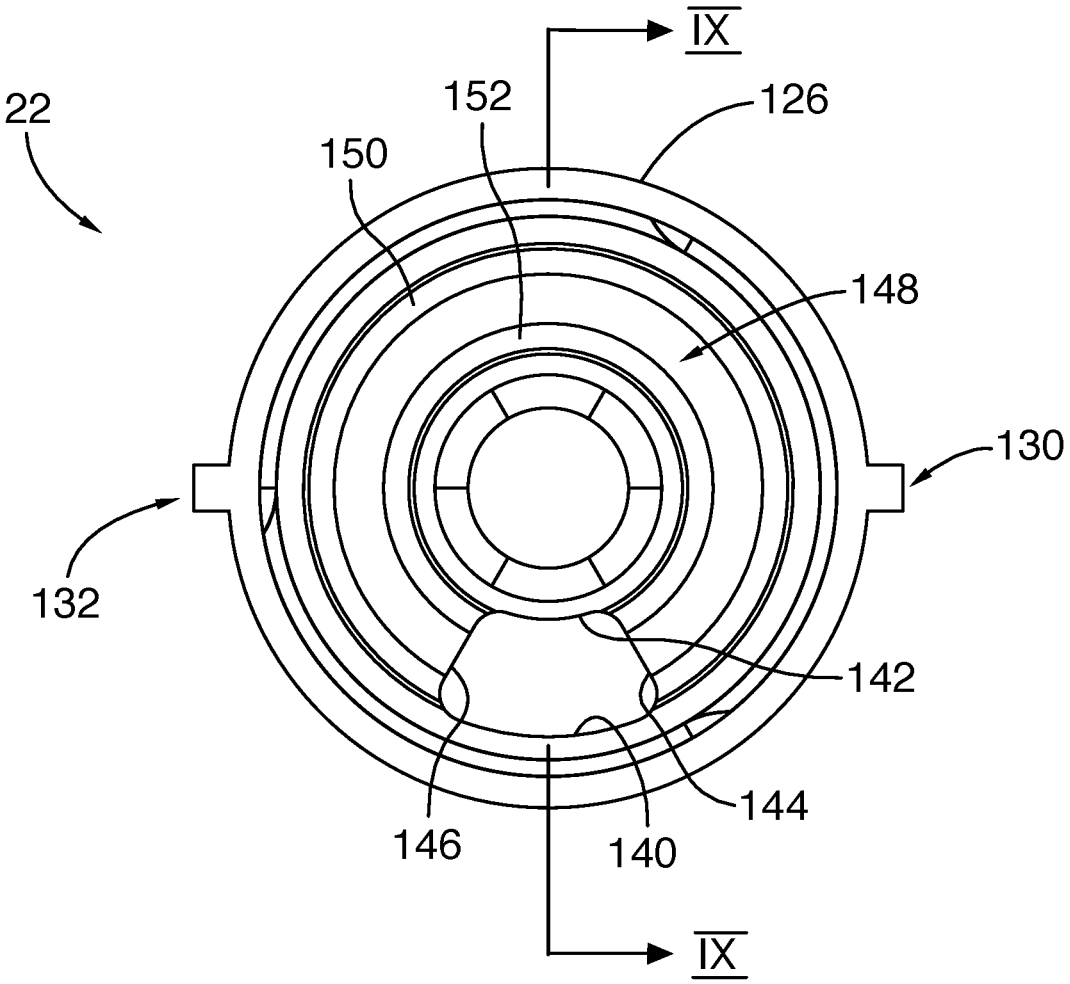
FIG. 10 is top plan view of the reciprocating element shown in FIG. 8.
Figure 11:
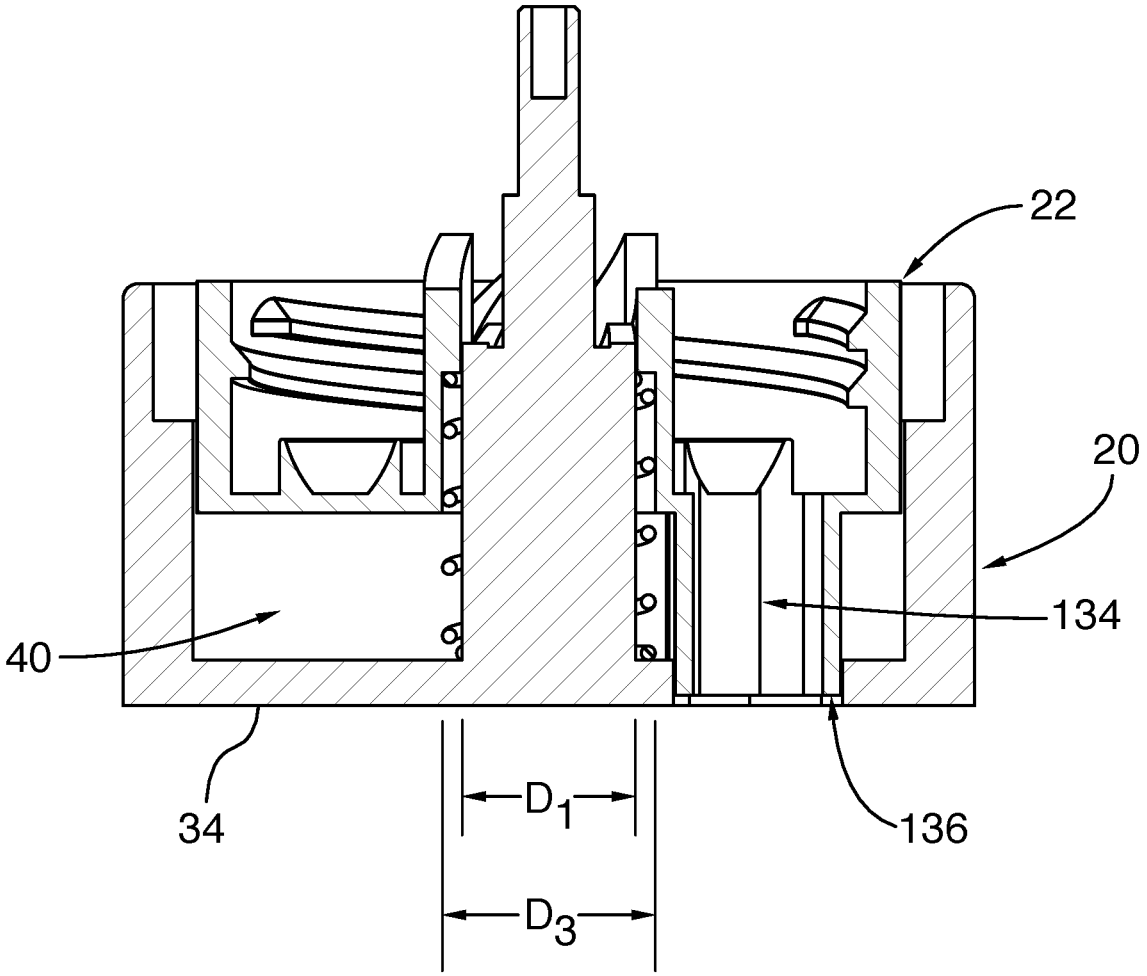
FIG. 11 is a cross-section view of the base, the first biasing assembly and the reciprocating element mounted therein, where the reciprocating element and the first biasing assembly are in the uncompressed position.
Figure 12:
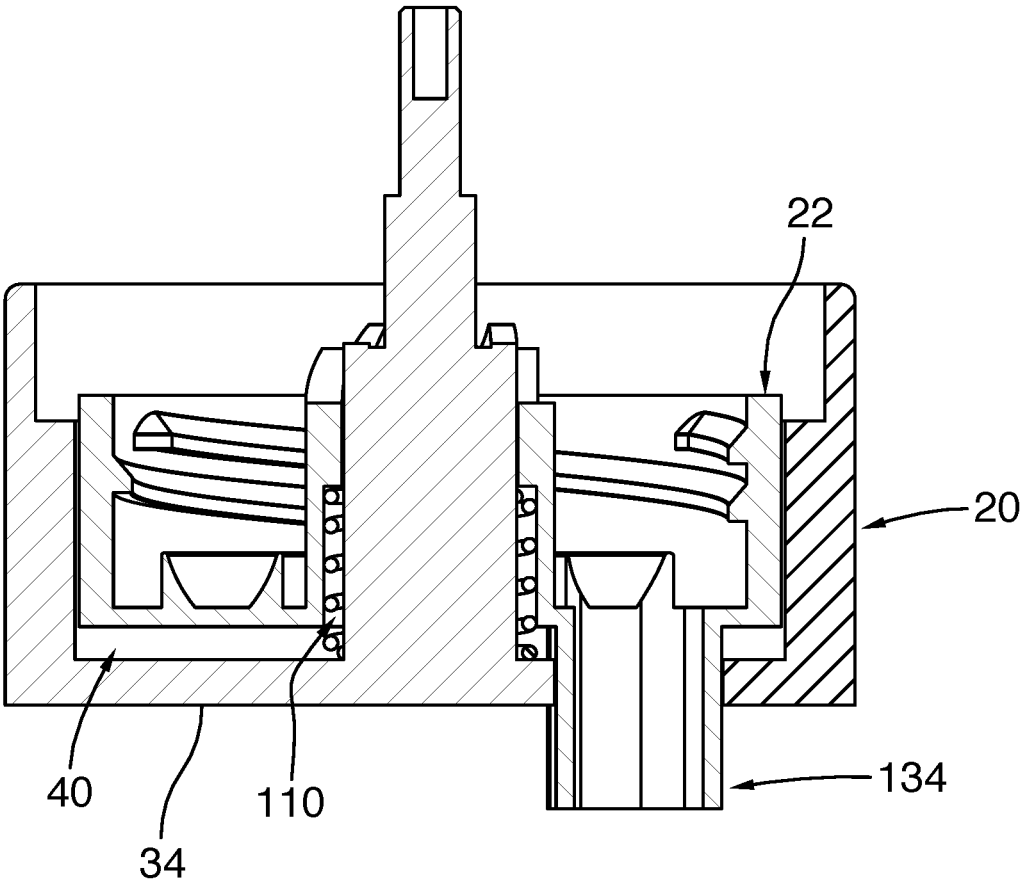
FIG. 12 is another cross-section view of the base, the first biasing assembly and the reciprocating element mounted therein, where the reciprocating element and the first biasing assembly are in the compressed position.
Figure 13:
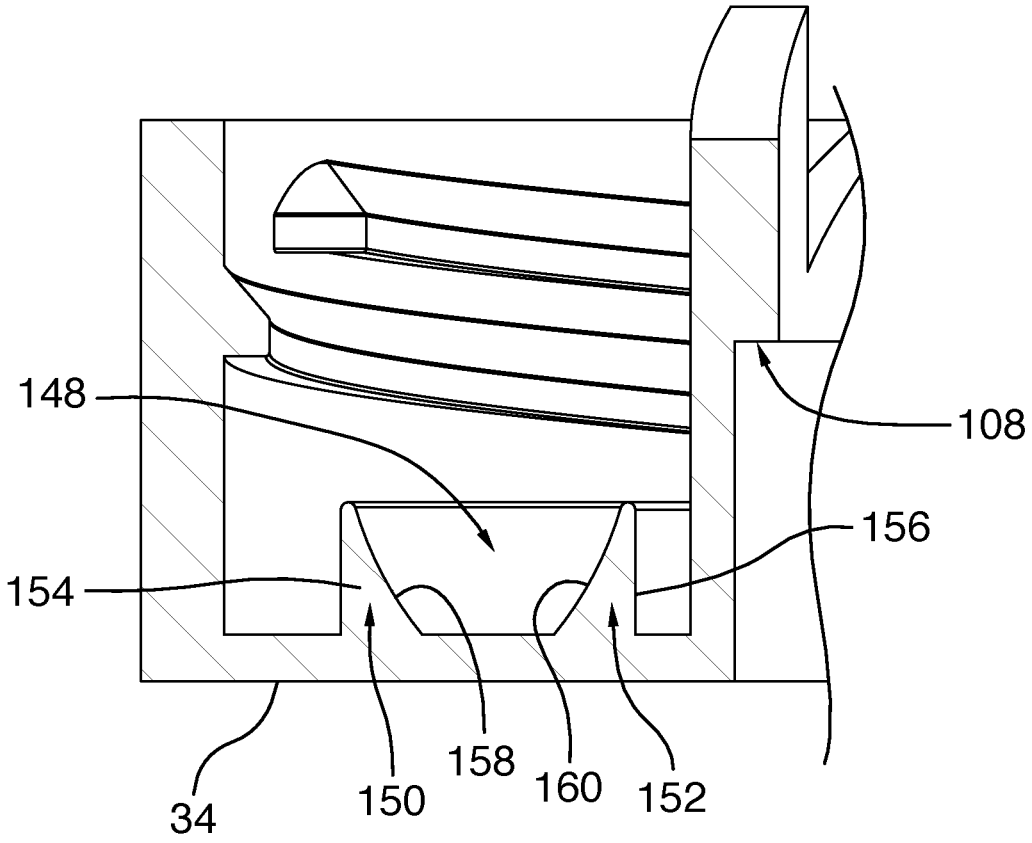
FIG. 13 is an enlarged cross-section view of a portion of the reciprocating element shown in FIG. 8, for better showing the guide channel.
Figure 14:
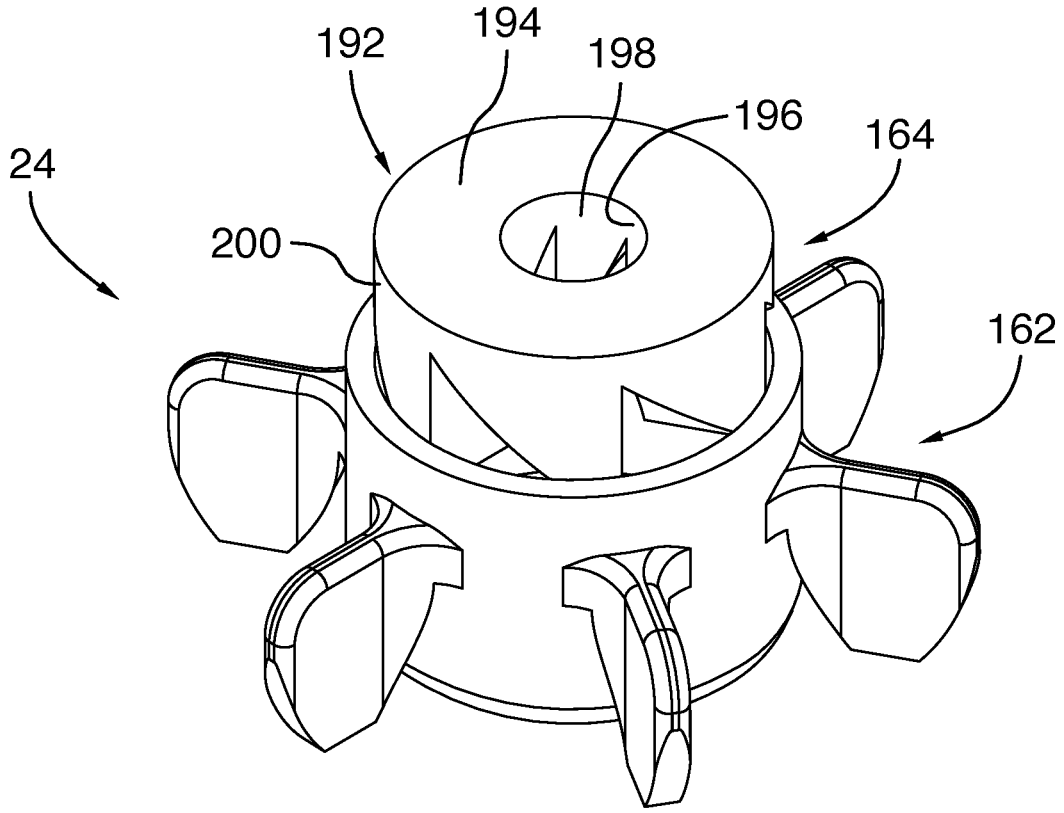
FIG. 14 is a side perspective view of the revolving distributor of the dispenser shown in FIG. 1.
Figure 15:
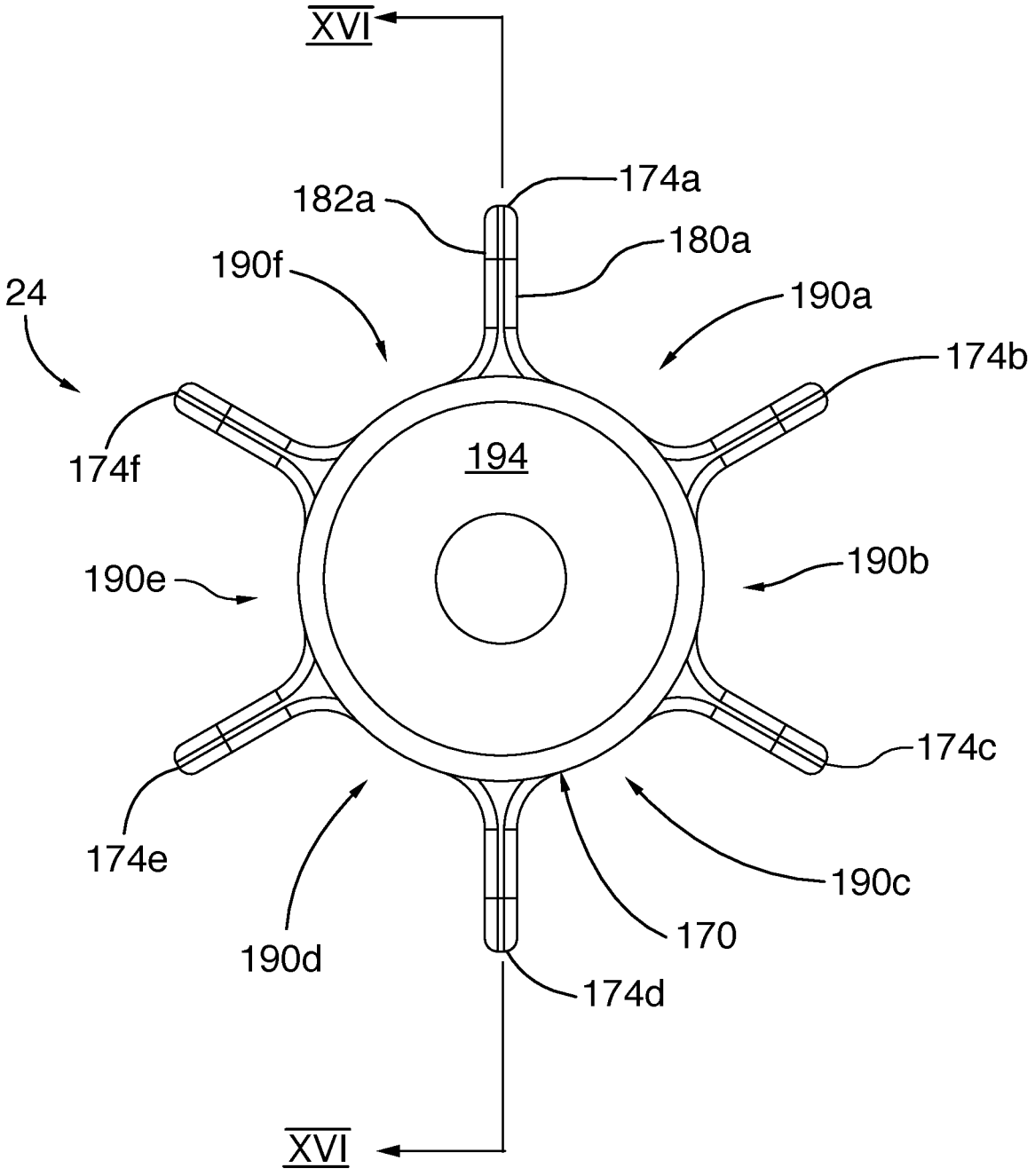
FIG. 15 is a top plan view of the revolving distributor shown in FIG. 14.
Figure 16:
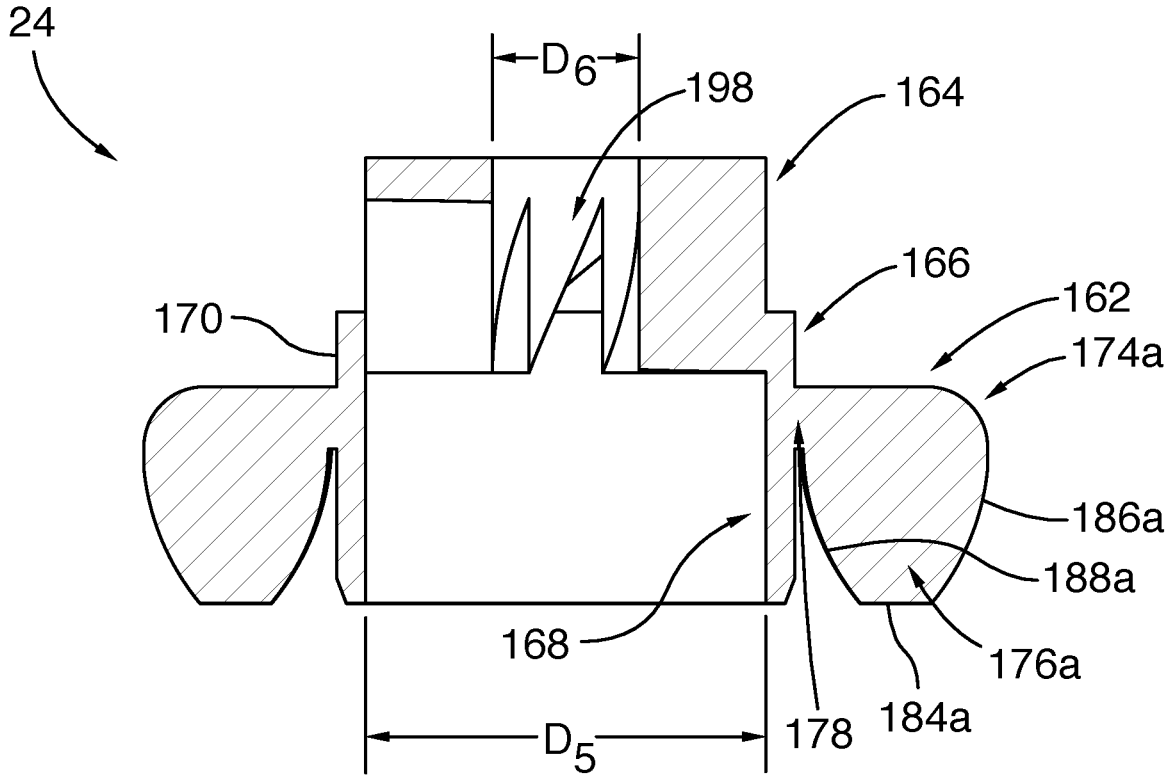
FIG. 16 is a cross-section view of the revolving distributor shown in FIG. 14, taken along line XVI-XVI.
Figure 17:
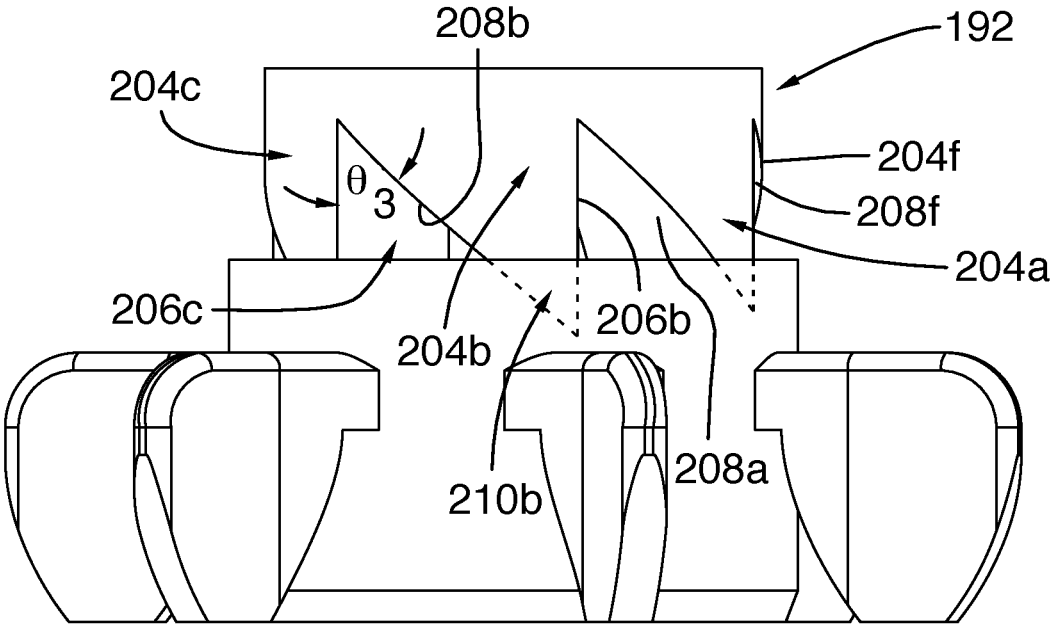
FIG. 17 is a side view of the revolving distributor shown in FIG. 14.

Turning to FIGS. 8 to 13, the reciprocating element 22 will now be described. Reciprocating element 22 is configured to be concentrically mounted in the base recess 40 for reciprocation between an uncompressed position (best shown in FIG. 10) and a compressed position (best shown in FIG. 11), as it will become apparent below. In the illustrated embodiment, reciprocating element 22 comprises an annular bottom wall 94, an inner cylindrical wall 96 and an outer cylindrical wall 98, the inner and outer cylindrical walls 96, 98 being spaced-apart from one another and extending upwardly from the annular bottom wall 94 to define an annular recess 100 of the reciprocating element 22. The reciprocating element 22 further comprises a bore 102 defined by the inner cylindrical wall 96. In the illustrated embodiment, the bore 102 has a lower portion 104 having a diameter $D_3$ and an upper portion 106, the bore 90 having a diameter $D_4$ slightly smaller than diameter $D_3$, the inner wall 96 therefore defining an abutment 108 for engaging the first biasing assembly 30, as it will become apparent below. As best shown in FIGS. 10 and 11, diameter $D_4$ of bore 102 is slightly wider that diameter $D_1$ of the lower portion 44 of projection 38 such that lower portion 44 can be received in bore 102 to allow reciprocation of the reciprocating element 22 between the uncompressed and compressed positions. Furthermore, because diameter $D_3$ is larger than diameter $D_4$ of bore 102 and diameter $D_1$ of the lower portion 44 of projection 38, an annular space 110 is defined between inner wall 96 of the reciprocating element 22 and the lower portion 44 of the projection 38, the annular space 110 being adapted to receive a portion of the first biasing assembly 30 therein.

Inner cylindrical wall 96 comprises a lower end 112 adjacent to the annular bottom wall 94 of the reciprocating element 22 and an upper end 114, the upper end 114 of the inner cylindrical wall 96 defining a dispensing portion 116 of the cam assembly 28. The dispensing portion 116 of the cam assembly 28 comprises six teeth 118*a*-118*f*, each tooth 118*a*-118*f* comprising a vertically extending face 120*a*-120*f* and a slanted face 122*a*-122*f*. Each of the slanted faces 122*a*-122*f* define an angle $\theta_2$ relative to rotation axis $R_1$-$R_1$, the angle $\theta_2$ corresponding to the angle $\theta_1$ of the slanted faces 76*a*-76*f* of teeth 72*a*-72*f* of the priming portion 54.

The outer cylindrical wall 98 of the reciprocating element 22 comprises an inner face 124 and an outer face 126. Extending inwardly from the inner face 124 is a thread 128 for engaging a corresponding thread 129 (shown in FIG. 1) provided on the neck 16 of the container 12 so as to secure the container 12 to the dispenser 10. While in the illustrated embodiment the means for securing the dispenser 10 to the container 12 consists in collaborating threads 128, 129, the person skilled in the art will appreciate that other means for securing the dispenser to the container. For instance, the threads 128, 129 could be located elsewhere on the reciprocating element 22 and on the container 12. Alternatively, instead of threads, the securing means could consist in a frictional engagement between the neck 16 of container 12 and the reciprocating element 22, a snap or clip engagement or any other way to secure the container 12 to the reciprocating element 12.

Extending outwardly from the outer face 126 of the outer cylindrical wall 98 is a pair of radially opposed tongues 130, 132, sized and shaped to engage grooves 90, 92 of the base 20 to prevent rotation of the reciprocating element 22 relative to base 20 (about rotation axis $R_1$-$R_1$) while allowing reciprocation of the reciprocating element 22 between the uncompressed and compressed positions.

The reciprocating element 22 further comprises a dispensing channel 134 including an upper end 136 adjacent to the annular bottom wall 94 and a lower end 138 from which the pill is dispensed. Extending between the upper end 136 and the lower end 138 is a curved outer wall 140, a curved inner wall 142 and a pair of side walls 144, 146. Together, walls 140, 142, 144 and 146 define a generally curved trapezoid cross-section (best shown in FIG. 9), the dispensing channel 134 being receivable in the dispensing opening 42 of the base 20 and to allow the passage of a pill to be dispensed therethrough. As best shown in FIG. 10, when the reciprocating element 22 of the dispenser 10 is in the uncompressed position, the lower end 136 of the dispensing channel 134 is generally aligned with the circular bottom wall 34 of the base 20 while when the reciprocating element 22 is in the compressed position (best shown in FIG. 11), a portion of walls 140, 142, 144 and 146 the dispensing channel 134 protrudes below circular bottom wall 34.

Provided in the annular recess 100 of the reciprocating element 22, and extending upwardly from the bottom wall 94 is an annular guide channel 148. The annular guide channel 148 has a generally U-shaped cross-section (see FIG. 12) defined by a pair of circular walls 150, 152 (FIG. 9) extending parallel to one another and each comprising a vertically extending face 154, 156 and an inclined face 158, 160, the inclined faces 158, 160 facing one another. As it will become apparent below, the inclined faces 158, 160 collaborate to maintain a pill to be dispensed in an upright position in the guide channel 148. While in this embodiment the reciprocating element 22 is provided with a guide channel 148 having a U-shaped cross-section, reciprocating element 22 could have no guide channel or a guide channel having a different cross-section, depending on the size and shape of the pills to be dispensed, and on the configuration of the revolving distributor 24.

The annular guide channel 148 collaborates with a portion of the revolving distributor 24 to force the pills to be dispensed standing in the guide channel 148 to be conveyed toward the dispensing channel 134. The revolving distributor 24 is mounted in the annular recess 100 of the reciprocating element 24 for rotation about rotation axis $R_1$-$R_1$. As such, recess 100 of the reciprocating element 22 is preferably annular. However, while in the illustrated embodiment the shape defined by the outer face 126 of the outer cylindrical wall 98 of reciprocating element 22 define a generally circular shape, the person skilled in the art will also understand that the shape defined by the outer face 126 of outer wall 98 of reciprocating element 22 could vary, provided that reciprocating element 22 is sized and shaped to be received in the recess 40 of base 20. Accordingly, if recess 40 of base 20 is generally square, the perimeter defined by the outer face 126 of outer wall 98 of reciprocating element 22 would also be square.

With reference to FIGS. 14 to 17, the revolving distributor 24 comprises a lower dispensing portion 162 and an upper cam portion 164 collaborating with the priming portion 54 and the dispensing portion 116 of the cam assembly 28 to urge rotation movement of the revolving distributor 24 about rotation axis $R_1$-$R_1$.

The lower dispensing portion 162 of the revolving distributor 24 comprises a cylindrical wall 166 having an inner face 168 and outer face 170, the inner face 168 defining a bore 172 having a diameter $D_5$ slightly larger than the inner cylindrical wall 96 of reciprocating element 22, such that the lower dispensing portion 162 is adapted to receive therein the inner cylindrical wall 96 of the reciprocating element 22 and the base projection 38 of the base 20 for allowing rotation of the revolving distributor 24 about the rotation axis $R_1$-$R_1$. Extending radially from the outer face 170 of cylindrical wall 166 are six projections 174*a*-174*f* configured to engage the guide channel 148 of the reciprocating element 22 for conveying the pills to be dispensed toward the dispensing channel 134. The six projections 174*a*-174*f* being identical, only projection 174*a* will be described, being understood that the same description applies to projections 174*b*-174*f*. Projection 174*a* comprises a generally U-shaped pushing portion 176*a* and an arm 178*a* for attaching the projection 174 to the cylindrical wall 166 of the lower dispensing portion 162. The pushing portion 176*a* is generally flat and extends parallel to the rotation axis $R_1$-$R_1$. The pushing portion 176*a* includes a leading face 180*a*, a trailing face 182*a*, a generally horizontal bottom edge 184*a* and a pair of inclined side edges 186*a*, 188*a*. When the reciprocating element 22 is in the uncompressed position, the lower end of pushing portion 176 engages the dispensing channel 134 of the reciprocating element 24, the bottom edge 184 of the pushing portion 176*a* being adjacent to the bottom wall 34 of the reciprocating element 24 and side edges 186*a*, 188*a* being adjacent to inclined faces 158 and 160 of the reciprocating element 24, respectively. As best seen from the top (see FIG. 14), a dispensing space 190*a*-190*f* is defined between each pair of adjacent projections 174*a*-174*f*, each of the dispensing spaces 190*a*-190*f* being sized and shaped to generally correspond to the cross-section of the dispensing channel 134 of the reciprocating element 24. Although in the illustrated embodiment, the lower portion 162 of the revolving distributor 24 is provide with six projections, it could be provided with a different number of projections. As it will be understood by the person skilled in the art, the number of projections 174*a*-174*f* and dispensing spaces 190*a*-190*f*, as well as their size and spacing can vary depending on the size of the pills to be dispensed. For instance, with a larger size medication, fewer dispensing space could be provided, where each dispensing space would be larger, while with a smaller sizer medication, more dispensing spaces of a smaller size could be provided.

The upper camp portion 164 of the revolving distributor 24 comprises an annular wall 192 including a generally flat top face 194, a curved inner face 196 defining a bore 198 having a diameter $D_6$ and a curved outer face 200.

Defined on a bottom end 202 of the annular wall 192 of cam portion 164 are six teeth 204*a*-204*f*, configured to engage teeth 72*a*-72*f* of the priming portion 54 and teeth 118*a*-118*f* of the dispensing portion 116 of the cam assembly 28. As such, each tooth 204*a*-204*f* comprises a vertically extending face 206*a*-206*f*, a slanted face 208*a*-208*f* and a tip portion 210*a*-210*f*, the slanted faces 208*a*-208*f* extending at an angle $\theta_3$ complementary to angles $\theta_1$ and $\theta_2$ of the priming and dispensing portions 54, 116 or the cam assembly 28. As it will become apparent below, the teeth 204*a*-204*f* of the upper cam portion 164 collaborate with the teeth 72*a*-72*f* and 118*a*-118*f* of the priming and dispensing portions 54 and 116, of the cam assembly 28 to urge rotation of the revolving distributor 24 about rotation axis $R_1$-$R_1$. The teeth 204*a*-204*f* of the upper cam portion 164 also serve to connect the upper cam portion 164 to the lower dispensing portion 162 of the revolving distributor 254, where the tips 210*a*-210*f* of teeth 204*a*-204*f* are attached to the inner face 168 of cylindrical wall 166 of the lower dispensing portion 162.

The person skilled in the art will also understand that the configuration of the cam assembly 28 will be adapted to the number and size of dispensing spaces. For instance, the cam assembly 28 will be adapted to urge a rotation of about 60 degrees at each cycle of compression/decompression (i.e. moving the reciprocating element 22 from the uncompressed position, to the compressed position and then back to the uncompressed position as seen in FIGS. 26A-26C and 27A-27B) of the dispenser 10 where six dispensing spaces are provided (e.g. dispensing spaces 190*a*-190*f*), while the cam assembly 28 will urge a rotation of about 90 degrees where four dispensing spaces are provided.

Figure 18:
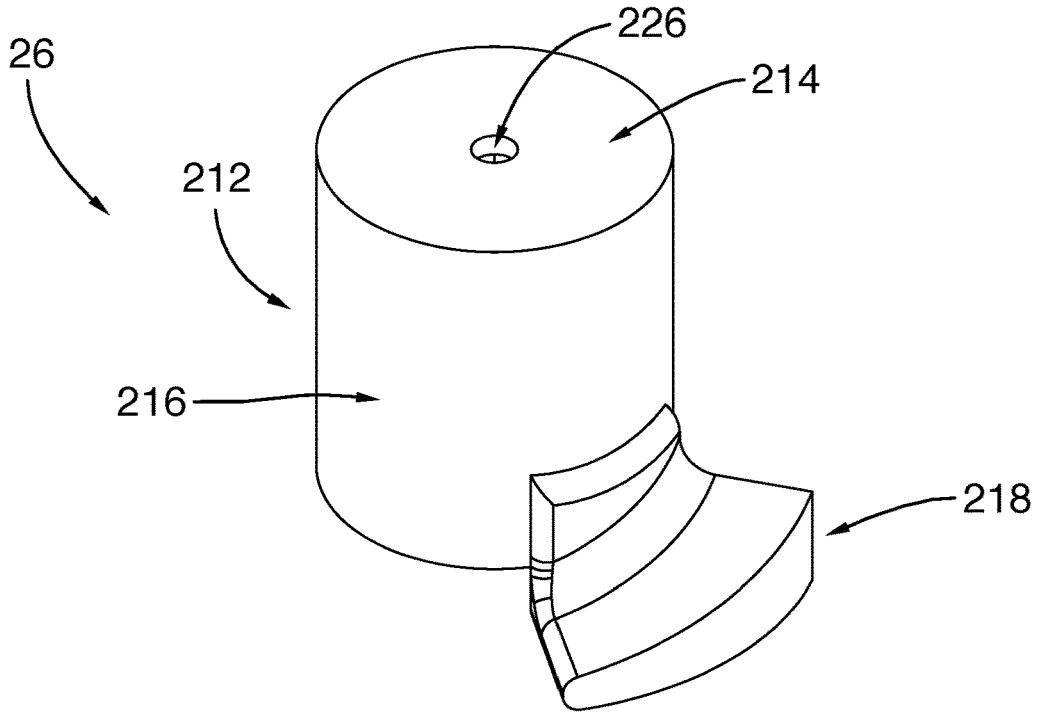
FIG. 18 is a side perspective view of the blocker of the dispenser shown in FIG. 1.
Figure 19:
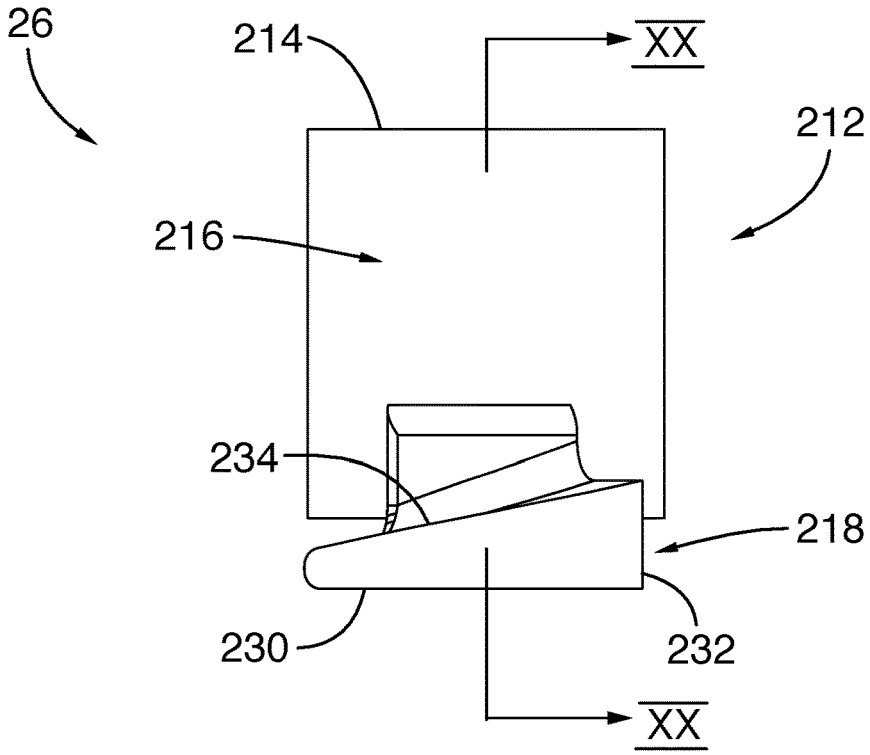
FIG. 19 is a side elevation view of the blocker shown in FIG. 18.
Figure 20:
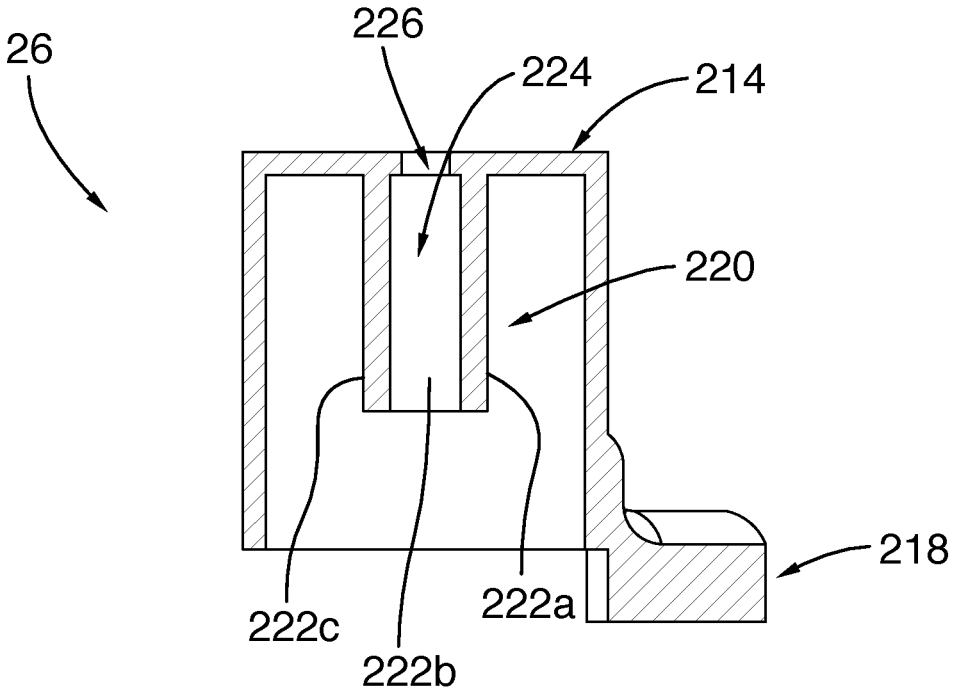
FIG. 20 is a cross-section view of the blocker shown in FIG. 18, taken along line XX-XX.
Figure 21:
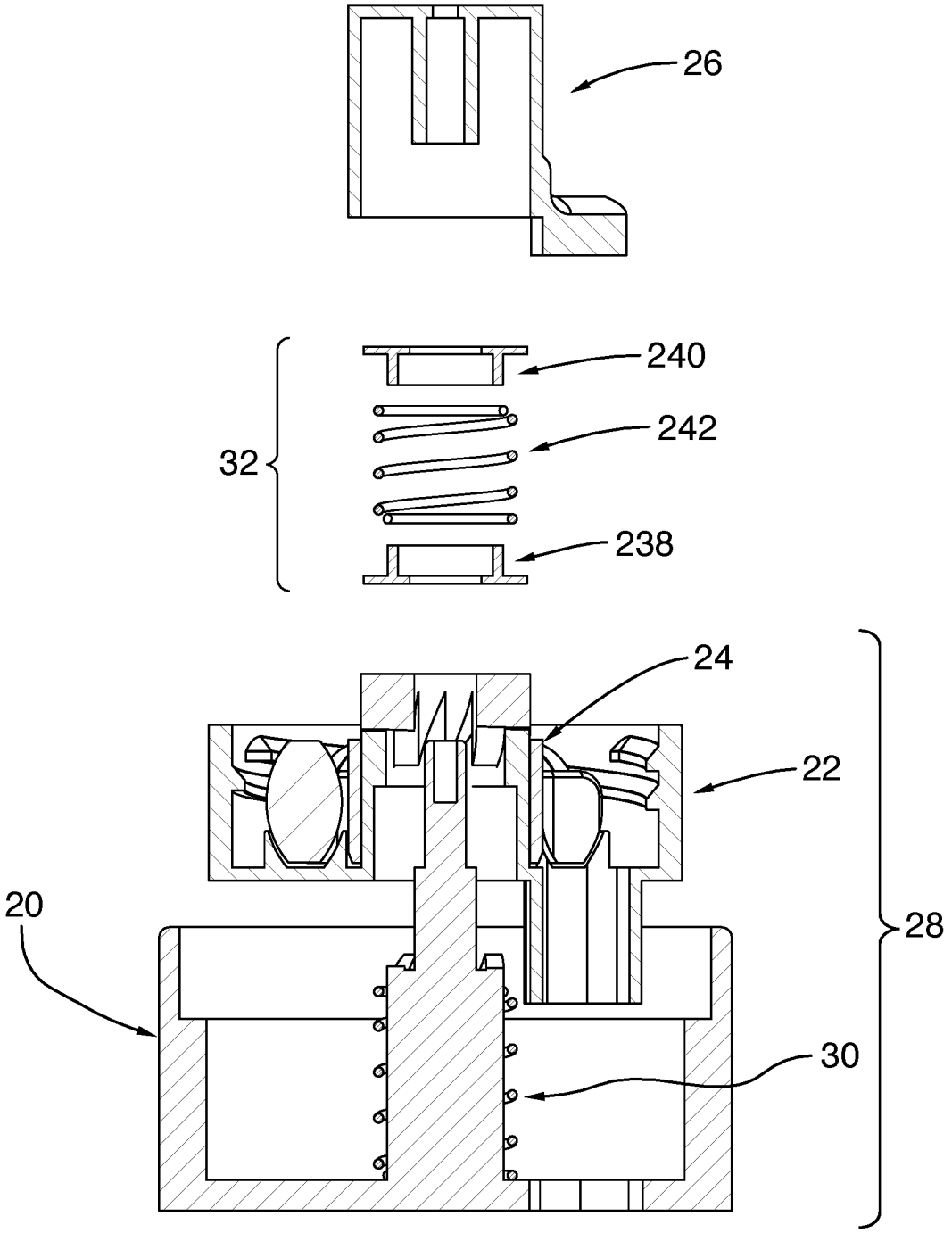
FIG. 21 is a cross-section, exploded view of the base, first biasing assembly, reciprocating element, second biasing assembly and blocker of the dispenser shown in FIG. 1.
Figure 22:
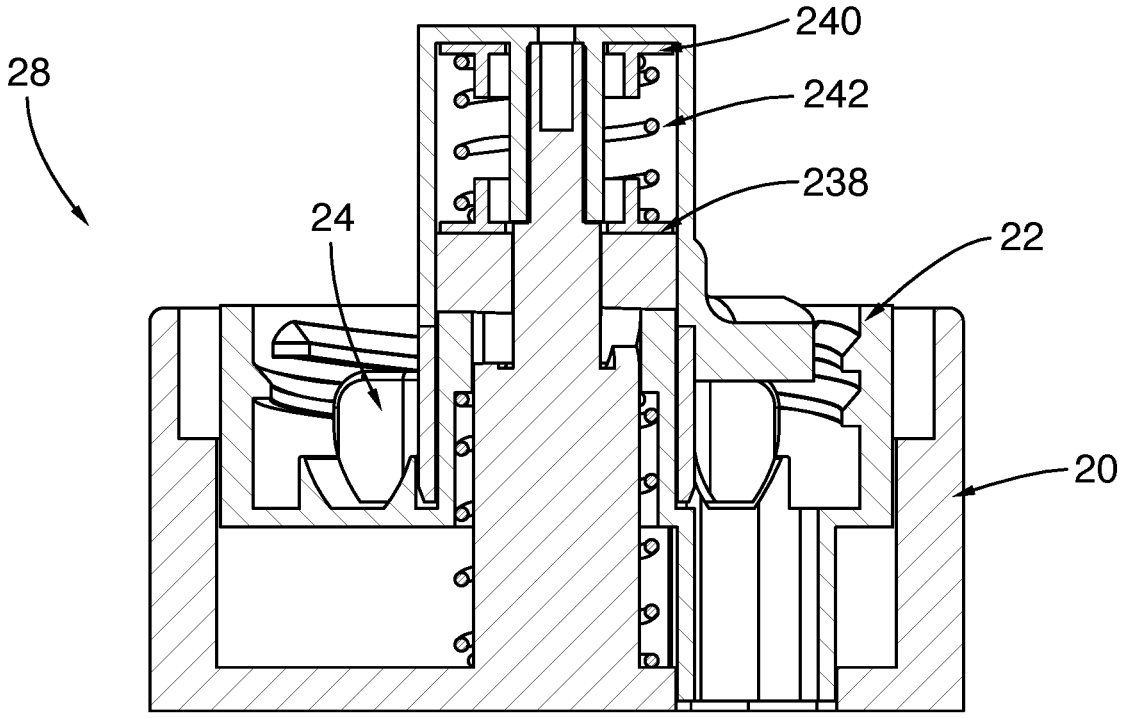
FIG. 22 is a cross section view of the base, first biasing assembly, reciprocating element, second biasing assembly and blocker of the dispenser shown in FIG. 1, with the reciprocating element and first biasing assembly in the uncompressed position.
Figure 23:
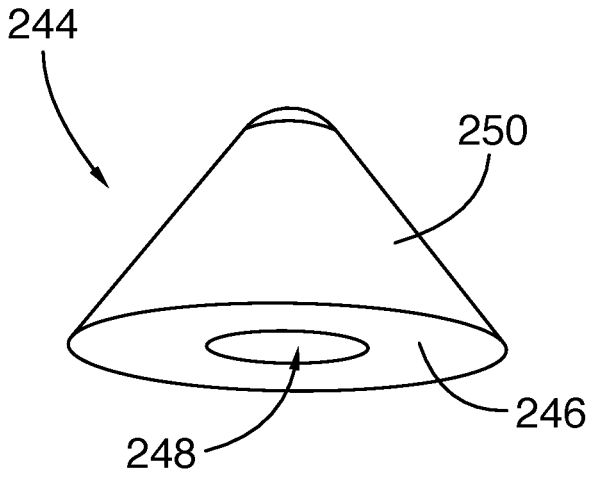
FIG. 23 is a bottom perspective view of the conical cover of the dispenser shown in FIG. 1.
Figure 24:
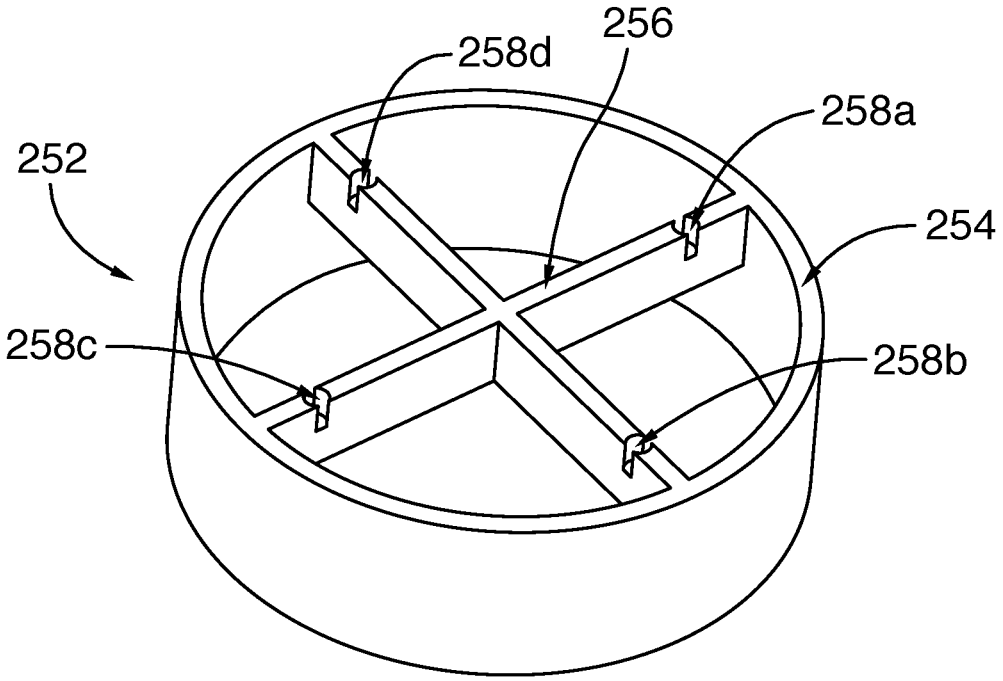
FIG. 24 is a top perspective view of the support of the dispenser shown in FIG. 1.

With reference to FIGS. 18 to 20, blocker 26 will now be described. Blocker 26 comprises a cylindrical body 212 including a circular top wall 214 and a cylindrical wall 216 extending downwardly from the top wall 214, the blocker 26 further comprising blocking projection 218 extending radially from the cylindrical wall 214 of the cylindrical body 212, atop of the dispensing channel 134 of the reciprocating element 22, and a mounting member 220 extending downwardly from the circular top wall 214 of the cylindrical body 212, at the center thereof. As it will become apparent below, the mounting member 220 of the blocker 26 is configured to engage the upper portion 48 of the projection 38 of base 20, to prevent rotation of the blocker 26 about the rotation axis $R_1$-$R_1$. More specifically, the mounting member 220 comprises four side walls 222*a*-222*d* defining together a channel 224 having a generally square cross-section (perpendicular to rotation axis $R_1$-$R_1$), the channel 224 being sized and shaped to receive the upper portion 48 of the projection 38 of the base 20. Defined in the circular top wall 214 of the cylindrical body 212, at the center thereof, is a hole 226. When the blocker 26 is mounted to the upper portion 48 of the projection 38 of the base 20, hole 226 is in alignment with the treaded bore 68 of the projection 48, to receive a threaded fastener 228 for securing the blocker 26 to the projection 38 of the base 20.

The blocking projection 218 of the blocker 26 comprises a generally flat bottom face 230, a generally flat, vertically extending back 232 face extending from the bottom face 230, perpendicular thereto, and a slanted top face 234 extending from the back face 232 to the bottom face 230. The slanted top face 234 allowing the pills located above to blocking projection 218 to be displaced in the rotation direction as revolving distributor 24 rotates about the rotation axis $R_1$-$R_1$.

Sandwiched between the annular wall 194 of the revolving distributor 24 and the circular wall 212 of the body 212 of blocker 26 is the second biasing assembly 32, configured to bias the revolving distributor 24 downwardly (i.e. toward the reciprocating element 22), to ensure proper contact between the cam portion 164 of the revolving distributor 24 and the priming and dispensing portions 54, 116 of the cam assembly 28. In the illustrated embodiment, the second biasing assembly 32 comprises a pair of spaced-apart ring members 238, 240 and a coil spring 242 mounted about the projection 38 of the base 20 and the mounting member 220 of the blocker 26. The first ring member 238 is resting on the annular wall 194 of the revolving distributor 24 while the second ring member 240 rests against the circular wall 214 of the blocker 26, the coil spring 242 extending between rings 238, 240 in a semi-compressed position. As such, when the reciprocating element 22 is moved downwardly (i.e. from the uncompressed position toward the uncompressed position), the coil spring 242 of the biasing assembly 236, in a semi-compressed state, will tend to expand, therefore forcing the revolving distributor 24 to maintain contact with the dispensing portion 116 of cam assembly 28 and then with the priming portion 54 of the cam assembly 28, as it will become apparent below. While in the illustrated embodiment, the second biasing assembly 32 comprises a coil spring 232, the person skilled in the art will appreciate that second biasing assembly 232 could be configured differently. For instance, coil spring 232 could be positioned elsewhere or a different type of spring could be used. Alternatively, instead of relying on a resilient element such as a spring, the second biasing assembly could rely on gravity, for instance by increasing the weight of the revolving distributor 24, for instance by manufacturing it from a metal material, or by adding an additional weight on the revolving distributor 24.

In the illustrated embodiment, dispenser 10 further comprising a conical cover 244 mounted to the circular top wall 214 of the cylindrical body 212. The conical cover 244 is configured to cover the threaded fastener 228 and to direct pills to be dispensed toward the sides of the blocker 26. The conical cover 26 comprises a flat bottom wall 246 provided with a hole 248, and a conical peripheral wall 250. The hole 248 is configure to snuggly engage the head 229 of the threaded fastener 228 to maintain the flat bottom wall 246 of the conical cover 244 in contact with the circular top wall 214 of the circular body 212. While in this embodiment the conical cover 236 has a conical shape, the person skilled in the art will appreciate that a cover could have a different shape. Alternatively, the dispenser 10 could have no cover at all or the cover could be replaced by a treaded fastener having a conical head.

In one embodiment, the dispenser 10 is provided with a support 252 for allowing the dispenser 10 and the container 12 secured thereto to be positioned on a horizontal surface such as a table or a countertop, and to be operated. Alternatively, the support 252 can be adapted to dispense pills in a recipient such as a glass, a can, a cup or any other type suitable container (not shown). Preferably, the recipient is adapted to be grasped by a user with reduced mobility such as a parkinsonian or an arthritic patient, and to be brought to the mouth for consumption of the pill dispensed therein without the need for the user to contact the pill. In this embodiment, support 252 comprises a cylindrical wall 254 having a perimeter corresponding generally to the perimeter defined by the cylindrical wall 36 of the base 20, and a cruciform cross-member 256. Since the dispensing channel 134 of the reciprocating element 22 protrudes below the circular bottom wall 34 of the base 20 when the reciprocating element 22 is in the compressed position, the cylindrical wall 254 of the support 252 is configured to allow the reciprocating element 22, and more particularly the dispensing channel 134, to be moved between the uncompressed position and the compressed position while leaving the dispenser 10 on the horizontal surface. Provided in the cruciform cross-member 256 are a plurality of holes 258*a*-258*d*, adapted to receive a corresponding plurality of pins (not shown). The pins (not shown) are also receivable in corresponding holes 260*a*-260*d* defined in the circular bottom wall 34 of the base 20 (shown in FIG. 7), to secure the support 252 to the base 20, as known by those skilled in the art. In an alternate embodiment, the support 252 could be integrally formed with the base, for instance by molding support 252 and base as a single part. Alternatively, holes 258*a*-258*d* and corresponding holes 260*a*-260*d* defined in the circular bottom wall 34 of the base 20 can be used to accommodate temporary pins to align the base 20 and the support 252 while they are glued together. In a further alternate embodiment, support 252 could be replaced with a different type of support or could be omitted.

Having described the various parts of dispenser 10, its assembly will now be described with reference to FIG. 25. In a first step, the base 20 is provided. The first biasing assembly (e.g. a coil spring) 30 is then positioned about projection 38, a first end 31 of the first coil spring 30 abutting the circular bottom wall 34 of the base 20. At this stage, the first coil spring 30 is in a relaxed position. The reciprocating element 22 is then positioned in the recess annular 40 of base 20. More particularly, the projection 38 of the base 20 is aligned with and engaged in bore 106 of the reciprocating element 22, and a second end 33 of the first coil spring 30 is positioned in the annular space 110, for abutting against abutment 108. The tongues 130,132 of the reciprocating element 22 are aligned with grooves 90, 92, and the dispensing channel 134 is aligned with and engaged in opening 42 of the base, and the reciprocating element 22 is forced downwardly (i.e. toward the compressed position) into the annular recess 40 of the base 20. At this stage, the reciprocating element 22 is maintained in the annular recess 40 of the base 20 using a clamp or another type of tool to allow the assembly of the other components of dispenser 10, as it would be known by a person skilled in the art.

The revolving distributor 24 is then positioned. The upper portion 48 of projection 38 of base 20 is aligned with and engaged in bore 198 of the revolving distributor 24, until bottom end 202 of the annular wall 192 of the revolving distributor 24 abuts the priming portion 54 and/or dispensing portion 116 of the cam assembly 28, depending on the compression state of the first coil spring 30. In this position, one dispensing space (e.g. 190*a*) of the revolving distributor 24 is in alignment with the dispensing channel 134 of the reciprocating element 22. The first ring member 238 is then positioned about the upper portion 48 of projection 38 of the base 20, to rest against annular wall 192 of the revolving distributor 24. Likewise, the second coil spring 242 and the second ring member 240 are positioned about the upper portion 48 of the projection of the base 20.

To secure the various components, the blocker 26 is then positioned. More specifically, the blocking projection 218 of blocker 26 is aligned on top of dispensing channel 134 of the reciprocating element 22 and opening 42 of the base. The upper portion 48 of projection 38 of the base 20 is then engaged into the channel 224 of the mounting member 220, and the second coil spring 242 is compressed until the mounting member 220 of the blocker 26 reaches the second end 60 of the middle portion 46 of the projection 38 of the base 20. At this stage, the hole 226 defined in the circular top wall 214 of blocker 26 is in registry with the treaded bore 68 defined in the projection 38 of base 20. The threaded fastener 228 is then used to secure the blocker 26 to the projection 38 of the base 20, thereby securing the reciprocating element 22, the revolving distributor 24, the two biasing assemblies 30, 32 and the blocker 26 to the base 20. The assembly of the dispenser is completed by assembly the conical cover 244 on top of blocker 26, by simply engaging the head of the threaded fastener 228 into hole 248, the conical cover 244 being maintained in position by frictional engagement between the wall 246 surrounding hole 248 and the head of the threaded fastener 228.

At this stage, dispenser 10 is configured to be operated. To do so, container 12 is attached to the reciprocating element 22 of the dispenser. More specifically, the neck 16 of container 12 is aligned in the annular recess 100 of the reciprocating element 22, the conical cover 244, the blocker 26 and the revolving distributor 24 being received in the orifice 18 of the container 12. The container 12 is then secured to the reciprocating element 22 by engaging the threads 128 of the reciprocating element with those of the container 12. As it will be appreciated by the person skilled in the art, it may be preferable to mount the dispenser 10 to the container 12 when the container is in an upright position to avoid spillage of spills.

Figure 28:
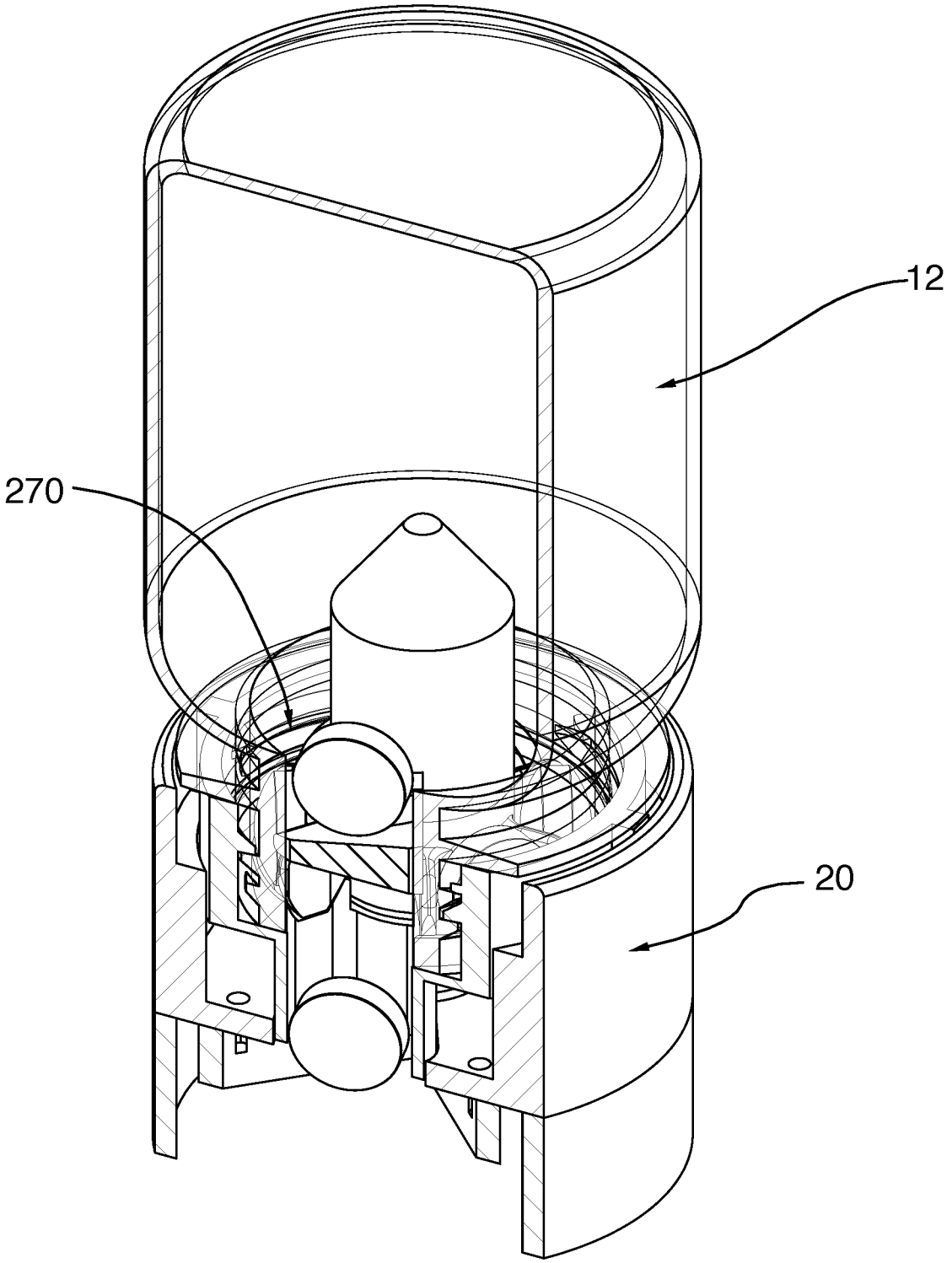
FIG. 28 is a perspective cross-section view of the dispenser and the container shown in FIG. 1.

To operate the dispenser 10, the pill container 12 to which the dispenser 10 is attached must be positioned in an upside-down position either on the support 252 or any other type of support, such that the pills contained in the container 12 will fall by gravity, through the orifice 18 of the container 12. As best shown in FIG. 28, the pills will be directed on each side of blocker 26 by the conical cover 244, the width and the height of the blocker 26 and conical cover 244 being configured to define with the neck 16 of the container 12 a cylindrical space 270 adapted to force the pills to be positioned in an upright position, ready to be received in the dispensing spaces 190*a*-190*f* of the revolving distributor 24 and to rest in the annular channel 148 of the reciprocating element 22, with the exception of the dispensing space located below the blocking projection of blocker 26 (e.g. dispensing space 190*a*), which remains empty due to the blocking projection 218 preventing the entry of a pill into that dispensing space (e.g. dispensing space 190*a*) which, for the purpose of this description, will be referred to as the "blocked" dispensing space. At this stage, the reciprocating element 22 is in the uncompressed position (see FIGS. 26A and 27A).

To dispense a pill, the user pushes downwardly on the bottom of the container 12 (which is now positioned on the top). As the container 12 is forced downwardly, the reciprocating element 22 is also forced downwardly in the annular recess 40 of base 20, the tongues 130, 132 following grooves 90, 92 and the dispensing channel 134 moving in opening 42 of the base.

As the reciprocating element 22 moves downwardly into the annular recess 40 of base 20, teeth 118*a*-118*f* of the dispensing portion 116 of the cam assembly 28 provided on the reciprocating element 22, gradually disengage from the teeth 204*a*-204*f* of the cam portion 164 of the revolving distributor 24, to completely disengage as the reciprocating element 24 reaches the compressed position (see FIG. 26B). Slightly before reaching the compressed position, the teeth 204*a*-204*f* of the revolving distributor 24 gradually engage teeth 72*a*-72*f* of the priming portion 54, found on the projection 38 of the base 20 (See FIG. 27A). As the second biasing assembly 32 is biased to force the revolving distributor 24 downwardly, the slanted faces 208*a*-208*f* of the teeth 204*a*-204*f* of the revolving distributor 24 collaborate with the slanted faces 74*a*-74*f* of the priming portion 54 of found on base 20 to urge a slight rotation movement of the revolving distributor 24 about rotation axis $R_1$-$R_1$, such that the revolving distributor will be in a "primed" position (see FIGS. 26B and 27B). In this primed position, the tip of teeth 210*a*-210*f* of the revolving distributor 24 are offset relative to the tip of teeth 118*a*-118*f* of the dispensing portion 116 (found on the inner cylindrical wall 96 of reciprocating element 22). As such, when the reciprocating element 22 is moved back from the compressed position to the uncompressed position (see FIG. 26C), the teeth 204*a*-204*f* of the revolving distributor 24 are positioned to be engaged by the subsequent teeth 118*a*-118*f* of the reciprocating element 22, the slanted faces 122*a*-122*f* of the dispensing portion 116 collaborating with the slanted faces 208*a*-208*f* of revolving distributor 24 to urge rotation of the revolving distributor 24 about rotation axis $R_1$-$R_1$.

As the revolving distributor 24 rotates, the leading faces 174*a*-174*f* of pushing portions engage the pills to be dispensed contained in the dispensing openings 176*a*-176*f* to travel in the rotation direction. Therefore, the pill contained in the dispensing space adjacent to the "blocked" dispensing space is forced under the blocking projection 218 of blocker 26. In this position, the pill is in alignment with the dispensing channel 134 of the reciprocating element 22, and travels through channel 134 to be dispensed. As the reciprocating element 22 is now in the uncompressed position, the dispenser 10 will remain in a steady state until the user actuates the dispenser 10 once again. Therefore, the blocking projection 210 of blocker 26 prevents the entry of pills into the dispensing space located below, while pills are directed toward the formerly blocked dispensing space which has become accessible by the slanted face 234 of blocking projection 210. As it will become apparent to the person skilled in the art, a single pill is thus dispensed at each reciprocation cycle.

Although the foregoing description and accompanying drawings relate to specific preferred embodiments of the present invention as presently contemplated by the inventor, it will be understood that various changes, modifications and adaptations, may be made without departing from the spirit of the invention.

The invention claimed is:

1. A dispenser for use with a container having a body and an orifice, the dispenser comprising:

a) a base including teeth, a base recess and a dispensing opening;

b) a reciprocating element mounted in the base recess for reciprocation between an uncompressed position and a compressed position, the reciprocating element including an annular recess and a dispensing channel configured to engage the dispensing opening of the base and to allow the passage of a pill from the annular recess, the reciprocating element further including a means for securing the dispenser to the container and teeth;

c) a first biasing assembly operatively coupled to the reciprocating element and configured to bias the first biasing assembly toward the uncompressed position;

d) a revolving distributor rotatably mounted in the annular recess of the reciprocating element, the revolving distributor including at least one dispensing space, the revolving distributor being rotatable about a rotation axis for allowing the at least one dispensing space to move between a filling position for allowing a pill to be dispensed to be received in the at least one dispensing space and a dispensing position in which the at least one dispensing space is in alignment with the dispensing channel of the reciprocating element, the revolving distributor further comprising teeth;

e) a means for preventing rotation of the reciprocating element relative about the rotation axis;

f) a blocker for blocking access to the at least one dispensing space in the dispensing position;

g) a cam assembly including, the teeth of the base, the teeth of the reciprocating element and the teeth of the revolving distributor, wherein when the reciprocating element is moved between the compressed and the uncompressed positions, the cam assembly forces a rotation of the revolving distributor such that the at least one dispensing space moves from the filling position to the dispensing position, whereby the rotation is caused by the collaboration of the teeth of the revolving distributor with the teeth of the base and the teeth of the reciprocating element.

2. A dispenser according to claim 1, wherein the base comprises a circular bottom wall, a cylindrical side wall extending upwardly from the bottom wall and a base projection extending upwardly from the center of the bottom wall to define the rotation axis, the bottom wall the side wall and the base projection together defining the base recess, the dispensing opening being defined in the bottom wall, eccentric to the rotation axis.

3. A dispenser according to claim 2, wherein the base projection comprises a lower portion, a middle portion and an upper portion, the lower portion having a lower end adjacent to the bottom wall of the base and an upper end defining a priming portion of the cam assembly and a cylindrical wall extending therebetween, the cylindrical wall of the lower portion defining a first diameter $D_1$.

4. A dispenser according to claim 3, wherein the middle portion of the base projection has a first end adjacent to the lower portion, a second end adjacent to the upper portion and a cylindrical wall extending therebetween, the cylindrical wall of the middle portion defining a second diameter $D_2$.

5. A dispenser according to claim 4, wherein the upper portion of the base projection comprises a first end adjacent to the second end of the middle portion, a second end and a peripheral wall configured to engage the blocker.

6. A dispenser according to claim 1, wherein the reciprocating element comprises an annular bottom wall, an inner cylindrical wall and an outer cylindrical wall, the inner and outer cylindrical walls being spaced-apart from one another and extending upwardly from the annular bottom wall to define the annular recess of the reciprocating element, the reciprocating element further comprising a bore defined by the inner cylindrical wall, the bore having a third diameter $D_3$ adapted to receive therein the lower portion of the base projection.

7. A dispenser according to claim 6, wherein the inner cylindrical wall comprises a lower end adjacent to the annular bottom wall of the reciprocating element and an upper end, the upper end of the inner cylindrical wall defining a dispensing portion of the cam assembly.

8. A dispenser according to claim 1, wherein the means for securing the dispenser to the container comprises a first thread portion defined on the reciprocating element, the first thread portion being configured to threadably engage a second thread portion defined on the body of the container.

9. A dispenser according to claim 1, wherein the means for preventing rotation of the reciprocating element comprises at least one groove defined in one of the base and the reciprocating element and at least one corresponding tongue defined in the other of the base and the reciprocating element.

10. A dispenser according to claim 6, wherein the revolving distributor comprises a lower dispensing portion and an upper cam portion.

11. A dispenser according to claim 10, wherein the lower dispensing portion of the revolving distributor comprises a cylindrical wall and at least one dispensing projection extending radially therefrom, the at least one dispensing projection defining the at least one dispensing space.

12. A dispenser according to claim 11, wherein the cylindrical wall of the lower dispensing portion defines a bore adapted to receive therein the inner cylindrical wall of the reciprocating element and the base projection for allowing rotation of the revolving distributor about the rotation axis.

13. A dispenser according to claim 11, wherein the at least one dispensing projection comprises a pushing portion and an arm portion for attaching the pushing portion to the cylindrical wall of the lower dispensing portion of the revolving distributor.

14. A dispenser according to claim 1, wherein the at least one dispensing space has a size and shape corresponding to a size and shape of the dispensing channel.

15. A dispenser according to claim 10, wherein the upper cam portion of the revolving distributor comprises a cylindrical wall having an upper end and a lower end, the lower end of the cylindrical wall of the upper cam portion being configured to collaborate with a priming portion of the base and the lower dispensing portion of the revolving distributor to define the cam assembly.

16. A dispenser according to claim 1, wherein the first biasing assembly comprises a spring.

17. A dispenser according to claim 2, wherein the blocker is mounted to the base projection.

18. A dispenser according to claim 17, wherein the blocker comprises a cylindrical body including a circular top wall and a cylindrical wall extending downwardly from the top wall, the blocker further comprising a blocking projection extending radially from the cylindrical wall of the cylindrical body atop of the dispensing channel of the reciprocating element, and a mounting member extending downwardly from the circular top wall of the cylindrical body, the mounting member of the blocker being configured to engage an upper portion of the base projection and to prevent rotation of the blocker about the rotation axis.

19. A dispenser according to claim 1, further comprising a conical cover mounted on the blocker, the conical cover being configured to direct pills to be dispensed toward the at least one dispensing space in the filling position when the at least one dispensing space is in the filling position.

20. A dispenser according to claim 1, further comprising a second biasing assembly operatively coupled to the revolving distributor and configured to bias the same toward the base.

21. A dispenser according to claim 1, further comprising a support for placing the dispenser on a horizontal surface or in a recipient.

22. A dispenser comprising:

a) a container having a body and an orifice;

b) a base including teeth, a base recess and a dispensing opening;

c) a reciprocating element mounted in the base recess for reciprocation between an uncompressed position and a compressed position, the reciprocating element including an annular recess and a dispensing channel configured to engage the dispensing opening of the base and to allow the passage of a pill from the annular recess, the reciprocating element further including a means for securing the reciprocating element to the container and teeth;

d) a first biasing assembly operatively coupled to the reciprocating element and configured to bias the first biasing assembly toward the uncompressed position;

e) a revolving distributor rotatably mounted in the annular recess of the reciprocating element, the revolving distributor including at least one dispensing space, the revolving distributor being rotatable about a rotation axis for allowing the at least one dispensing space to move between a filling position for allowing a pill to be dispensed to be received in the at least one dispensing space and a dispensing position in which the at least one dispensing space is in alignment with the dispensing channel of the reciprocating element, the revolving distributor further comprising teeth;

f) a means for preventing rotation of the reciprocating element relative about the rotation axis;

g) a blocker for blocking access to the at least one dispensing space in the dispensing position;

h) a cam assembly including, the teeth of the base, the teeth of the reciprocating element and the teeth of the revolving distributor, wherein when the reciprocating element is moved between the compressed and the uncompressed positions, the cam assembly forces a rotation of the revolving distributor such that the at least one dispensing space moves from the filling position to the dispensing position, whereby the rotation is caused by the collaboration of the teeth of the revolving distributor with the teeth of the base and the teeth of the reciprocating element.

* * * * *